US007357267B1

(12) United States Patent
Shimada et al.

(10) Patent No.: US 7,357,267 B1
(45) Date of Patent: Apr. 15, 2008

(54) PLASTIC BOTTLE WITH HANDLE

(75) Inventors: Shinji Shimada, Tokyo (JP); Kazuaki Nose, Tokyo (JP); Atsushi Ota, Tokyo (JP); Keisuke Miyairi, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 1294 days.

(21) Appl. No.: 09/424,056

(22) PCT Filed: Mar. 19, 1999

(86) PCT No.: PCT/JP99/01405

§ 371 (c)(1),
(2), (4) Date: Nov. 18, 1999

(87) PCT Pub. No.: WO99/48763

PCT Pub. Date: Sep. 30, 1999

(30) Foreign Application Priority Data

Mar. 20, 1998 (JP) ..... 10-092549
Apr. 10, 1998 (JP) ..... 10-098637
Sep. 30, 1998 (JP) ..... 10-292978

(51) Int. Cl.
*B65D 23/10* (2006.01)
*B65D 90/02* (2006.01)
*B65D 25/28* (2006.01)

(52) U.S. Cl. ..... 215/381; 215/382; 215/398; 215/396; 215/900

(58) Field of Classification Search ..... 215/398, 215/399, 900, 396, 383, 384, 381, 382; 220/752, 220/754, 761, 771, 756, 675; 16/405, 425
See application file for complete search history.

(56) References Cited

U.S. PATENT DOCUMENTS 2,362,523 A * 11/1944 Armstrong, Jr. et al. .... 215/399
3,463,536 A * 8/1969 Updegraff et al. ..... 294/31.2
3,474,844 A * 10/1969 Lindstrom et al. ..... 215/900 X
3,481,501 A * 12/1969 Anderson ..... 215/397
3,484,013 A * 12/1969 Speicher ..... 215/399
3,638,834 A * 2/1972 Goodrich et al. ..... 222/105
3,921,630 A * 11/1975 McPhee ..... 215/900 X
3,926,341 A * 12/1975 Lhoest ..... 215/900 X (Continued)

FOREIGN PATENT DOCUMENTS

EP 287170 * 10/1988 ..... 215/900

(Continued)

OTHER PUBLICATIONS

Translation of JP 9-254946.*
Translation of JP 8-324534.*
Translation of JP 60-024734.*

*Primary Examiner*—Anthony D. Stashick
*Assistant Examiner*—Niki M. Eloshway
(74) *Attorney, Agent, or Firm*—Oliff & Berridge, PLC

(57) ABSTRACT

A squeezable plastic bottle with a handle which is bendable by forming a bending deformation portion in the handle. The bending deformation portion of the handle can be a bending portion formed in the middle portion of the longitudinal direction of the handle. Further a bending rib can be formed between the handle and the body wall surface. The body may be squeezable and deformable by forming a bending rib in the bottle body.

18 Claims, 42 Drawing Sheets

U.S. PATENT DOCUMENTS 4,076,063 A * 2/1978 Cammarata, III et al. .. 215/900
4,257,525 A * 3/1981 Thompson ..... 215/396
D271,746 S * 12/1983 Pieri ..... D9/521
4,627,546 A * 12/1986 Carranza ..... 215/396
4,747,519 A * 5/1988 Green et al. ..... 215/399
4,925,055 A * 5/1990 Robbins, III et al. ... 215/399 X
5,092,476 A * 3/1992 Yasuda et al. ..... 215/398
5,174,458 A * 12/1992 Segati
5,183,169 A * 2/1993 Grzych ..... 215/395
5,221,016 A * 6/1993 Karpal ..... 215/900 X
5,246,122 A * 9/1993 Schick et al. ..... 215/900 X
5,255,808 A * 10/1993 Tobler ..... 215/900 X
5,269,427 A * 12/1993 Hurd ..... 215/900 X
5,469,612 A * 11/1995 Collette et al. ..... 29/453
5,632,406 A * 5/1997 Robbins, III ..... 215/900 X
5,647,624 A * 7/1997 Beshara, Jr. ..... 294/27.1
5,711,445 A * 1/1998 Robbins, III ..... 215/900 X
5,951,076 A * 9/1999 Marco ..... 294/27.1
6,125,563 A * 10/2000 Girerd ..... 40/310

FOREIGN PATENT DOCUMENTS

| | | | |
|---|---|---|---|
| JP | U-58-82333 | | 6/1983 |
| JP | U-60-24734 | | 2/1985 |
| JP | A-2-32950 | | 2/1990 |
| JP | A-7-52934 | | 2/1995 |
| JP | A-8-324534 | | 12/1996 |
| JP | 9 254946 | * | 9/1997 |
| JP | A-10-59372 | | 3/1998 |
| JP | 10 157721 | * | 6/1998 |
| JP | 10-167243 | | 6/1998 |
| JP | 1025818 | | 9/1998 |
| JP | 1025819 | | 9/1998 |
| JP | 1025822 | | 9/1998 |
| JP | 11 292082 | * | 10/1999 |

* cited by examiner

PLASTIC BOTTLE WITH HANDLE

FIELD OF THE INVENTION

The present invention relates to an easily squeezable plastic bottle with a handle.

BACKGROUND OF THE INVENTION

Recently a disposing of wasted plastic has been a serious problem and a recycle of used plastic containers has been practiced.

Further it has been encouraged and practiced to squeeze containers for disposal to decrease a volume of waste.

Therefore some kinds of easily squeezable plastic containers have been proposed up to now.

However for keeping a certain appearance with containing and protecting liquid contents therein, plastic containers need to have a certain intensity, and a considerable squeezing force has been required for decreasing a volume of used empty plastic containers.

Especially for the plastic bottle with a handle, there has been a problem of a difficulty to squeeze the bottle due to a thick body wall thereof, and the handle portion is difficult to be squeezed.

Further together with the handle, the lower wall surface portion of the bottle body beneath the handle cannot be sufficiently deformed to efficiently decrease a volume of said upper body.

Therefore presently users waste plastic bottles with a handle as it is without squeezing them.

Resultantly the bulk of wasted plastic have been increased and a problem of inefficiency for transporting waste has not been solved.

While if the bottle could be easily squeezed, to prevent the bottle from recovering to the original shape, the internal pressure in the bottle should be kept its depression by putting a cap on the bottle during it being squeezed, therefore it has caused a problem of blending different kinds of materials with waste plastics at the time of recycling operation thereof.

It is an object of the present invention, for solving problems described hereinbefore, to provide various kinds of plastic bottles with a handle for keeping a certain intensity of containing liquid contents, such as at first a flat bottle for disposal which body is flattened by enable of squeezing the handle, the second a flattened and folded bottle into a considerably little capacity and the third a folded waste bottle capable of being wasted without covering a cap if required.

DISCLOSURE OF THE INVENTION

In order to achieve objects of the present invention, this invention is constituted as follows.

The bending deformation portion is formed in the handle of the plastic bottle to squeeze the handle and to efficiently decrease a volume of the upper body portion.

Preferably the bending deformation portion is formed in the middle portion of the longitudinal direction of the handle. The bending portion is formed in the middle bulging portion in the center of the longitudinal direction of the handle, and comprises of the concave portion, the concave rib and the like formed in the outer circumference and/or the inner circumference of the middle bulged portion.

More preferably the bending rib is arranged between the upper end and the body wall surface.

To obtain the flat bottle for disposal which the body portion is flattened, the bending rib may be formed in the body of the plastic bottle for the squeezable and deformable body wall.

The body of the plastic bottle comprises the upper body including the handle, the lower body and the bottom. The upper body comprises the curved wall on the side surface for attaching the handle and the side wall. The bending rib extending laterally may be formed in the curved wall and the side wall adjacent to the curved wall, thereby the upper body of the bottle can be further squeezed by bending the handle.

To obtain the further folded bottle for disposal that the volume is efficiently decrease, further one or more hanging pieces may be projected from the bottom and the engaging piece having the hook may be erected from the upper end portion of the handle.

Furthermore to waste the bottle separately from the cap, the hanging piece having the hook may be projected from the left side of the bottom wall surface of the bottom to engage the hanging piece with the neck in preventing from covering the cap, and the bottle can be necessarily distinguished for recycling the waste things.

For achieving an easily squeezing, the indication showing sequence numbers of squeezing and/or the operation contents of squeezing according to the operation procedures of squeezing may be formed in the predetermined place.

DETAILED DESCRIPTION OF THE PREFERRED EMBODIMENTS

The first embodiment of the present invention will be described in conjunction with accompanied drawings FIGS. 1 to 14.

Figure 1:
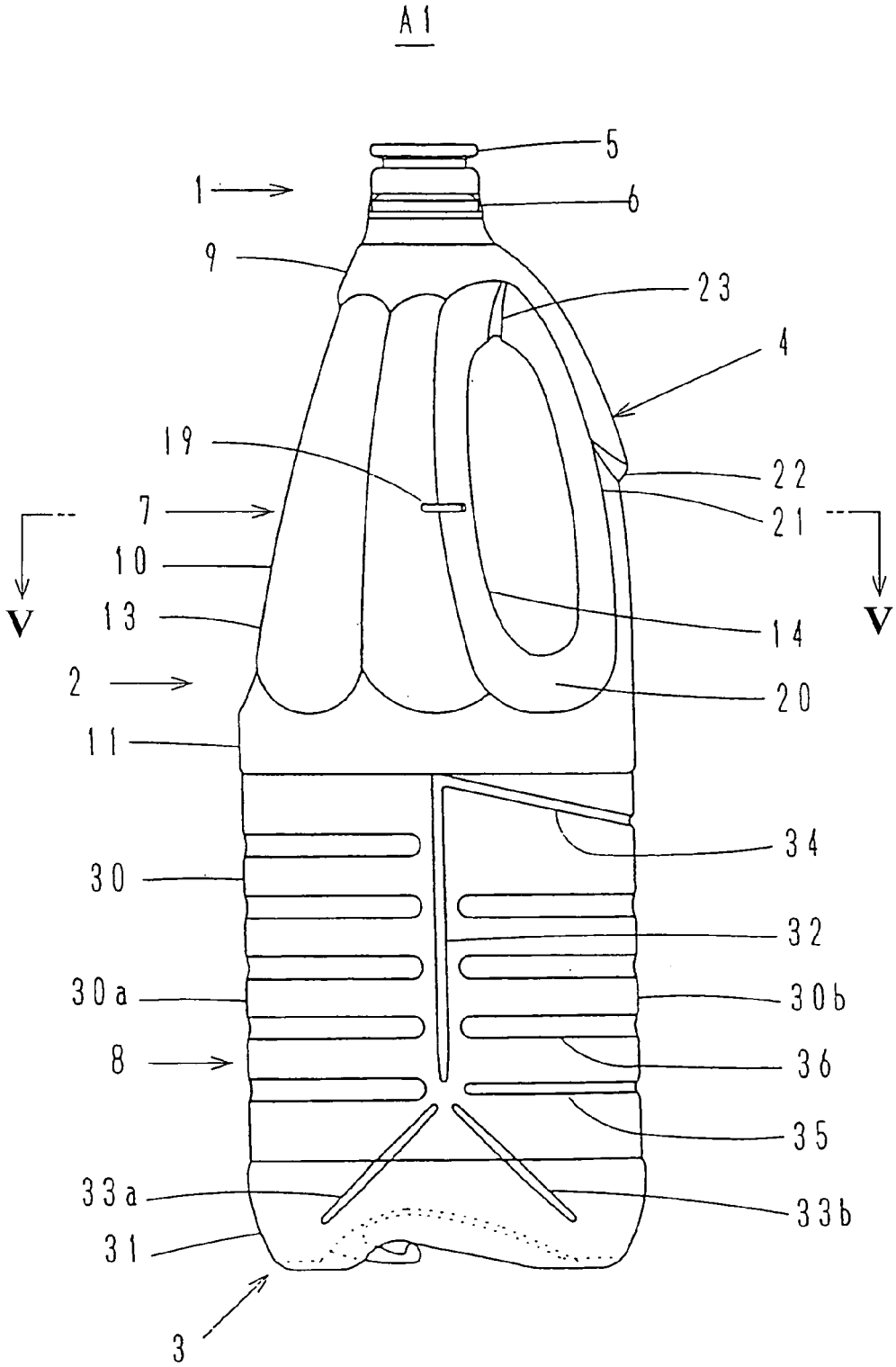
FIG. 1 is a front view of a plastic bottle according to the first embodiment of the present invention.
Figure 2:
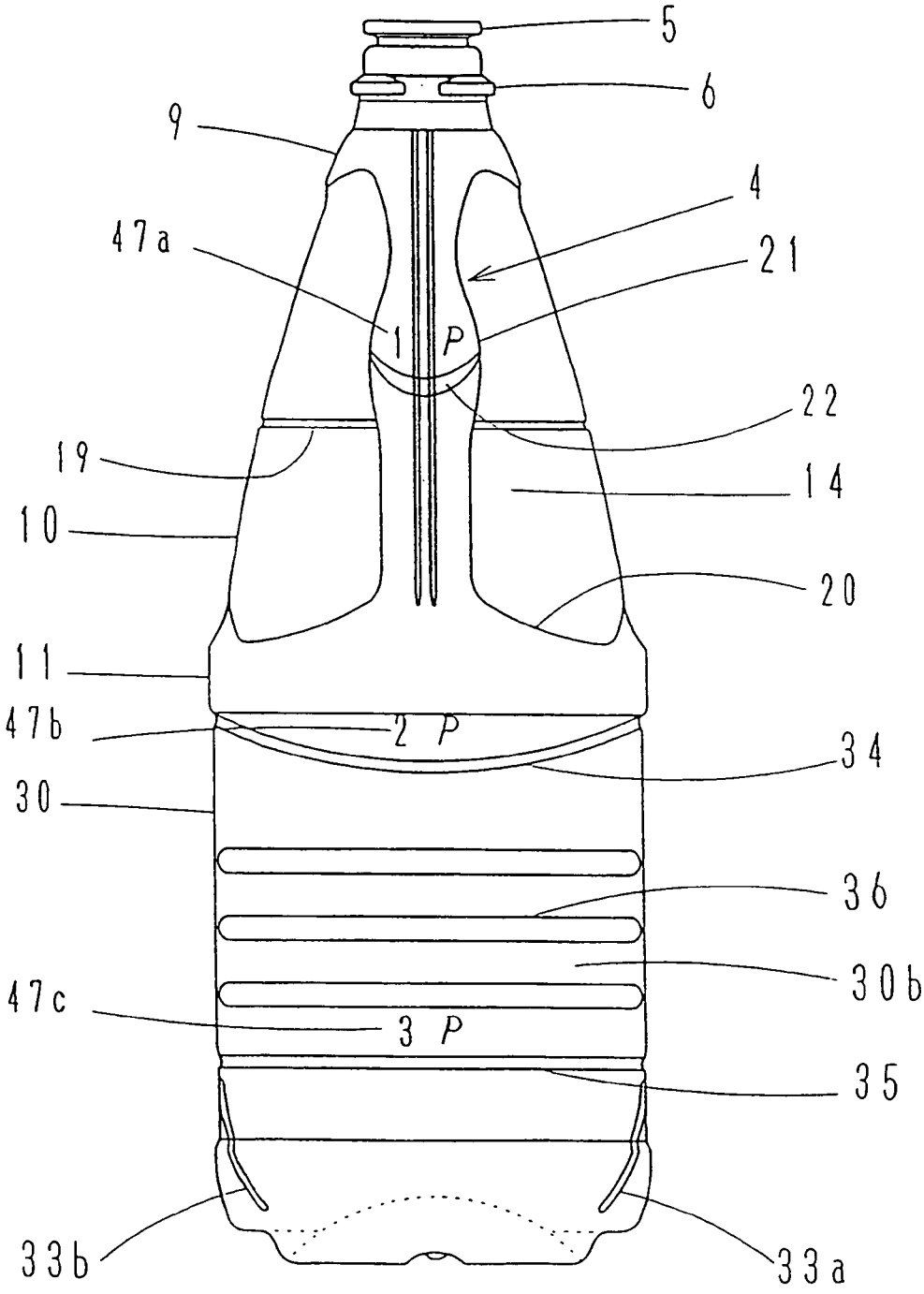
FIG. 2 is a right side view of the bottle shown in FIG. 1.

As shown in FIGS. 1 and 2, a bottle A1 comprises a neck 1, a body 2 and a bottom 3, and the body 2 includes a handle 4.

The bottle A1, for example is formed by blow molding a synthetic resin such as polyolefins resin. The bottle A1 may be made of a single layer synthetic resin or of multi-layered one.

A lateral rib collar (ring) 5 and a holding lip 6 are provided around an outer circumference of the neck 1.

The body 2 comprises an upper body 7 including the handle 4 and a lower body 8 having a circular cross sectional shape. The upper body 7 comprises a shoulder wall 9 having a semi-spherical shape adjacent to the neck 1, a circumferential wall 10 adjacent to the shoulder wall 9 with a ridge line, and a bulged circumferential wall 11 having a circular cross section.

The circumferential wall 10 comprises a side wall 13 formed between the shoulder wall 9 and the bulged circumferential wall 11, and an inwardly curved wall 14 curved to a direction of an axis of the bottle for receiving the handle.

Figure 3:
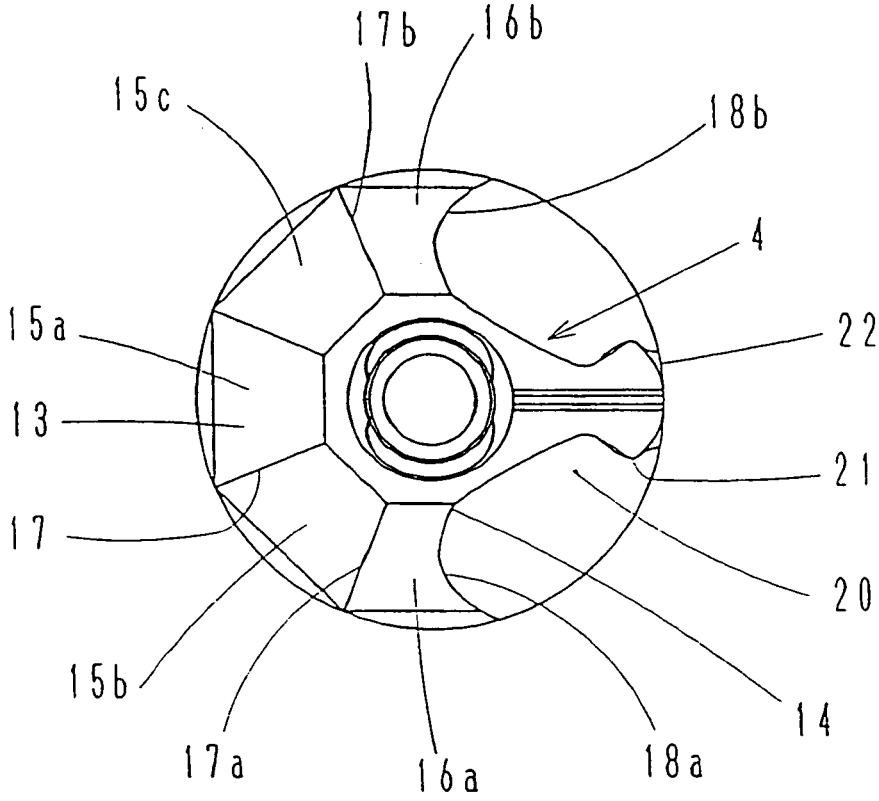
FIG. 3 is a plane view of the bottle shown in FIG. 1.

As shown in FIG. 3, the side wall 13 comprises a left side wall 15*a*, a front-left side wall 15*b* adjacent to the left side wall 15*a*, a rear-left side wall 15*c* adjacent to the left side wall 15*a*, a front side wall 16*a*, and a rear side wall 16*b*. The side wall 13 is formed by a slightly inwardly curved surface, and includes a ridge line 17 extending between a lower edge of the shoulder 9 and an upper edge of the bulged circumferential wall 11 (FIGS. 1 and 3).

The "left", "right", "front" and "rear" sides as referred in this specification mean a position and a direction with respect to the bottle axis in a front view and a plane view. The "right" side means the side of the bottle where the handle is attached.

Each of the front side wall 16*a* and the rear side wall 16*b* has the curve surface same as respective side walls 15*a*, 15*b*, 15*c*. The front side wall 16*a* connects with the front-left side wall 15*b* via the ridge line 17*a*, and the rear side wall 16*b* connects with the rear-left side wall 15*c* via the ridge line 17*b*. The front side wall 16*a* includes a ride line 18*a* on the other side of the ridge line 17*a*, and the rear side wall 16*b* includes a ridge line 18*b* on the other side of the ridge line 17*b*.

The inwardly curved wall 14 is adjacent to the front side wall 16*a* and the rear side wall 16*b* respectively through ridge lines 18*a*, 18*b*. The wall 14 is a surface slightly inwardly curved in a longitudinal cross section spaced from the axis of the bottle, and has a cross sectional shape of an arch.

Figure 5:
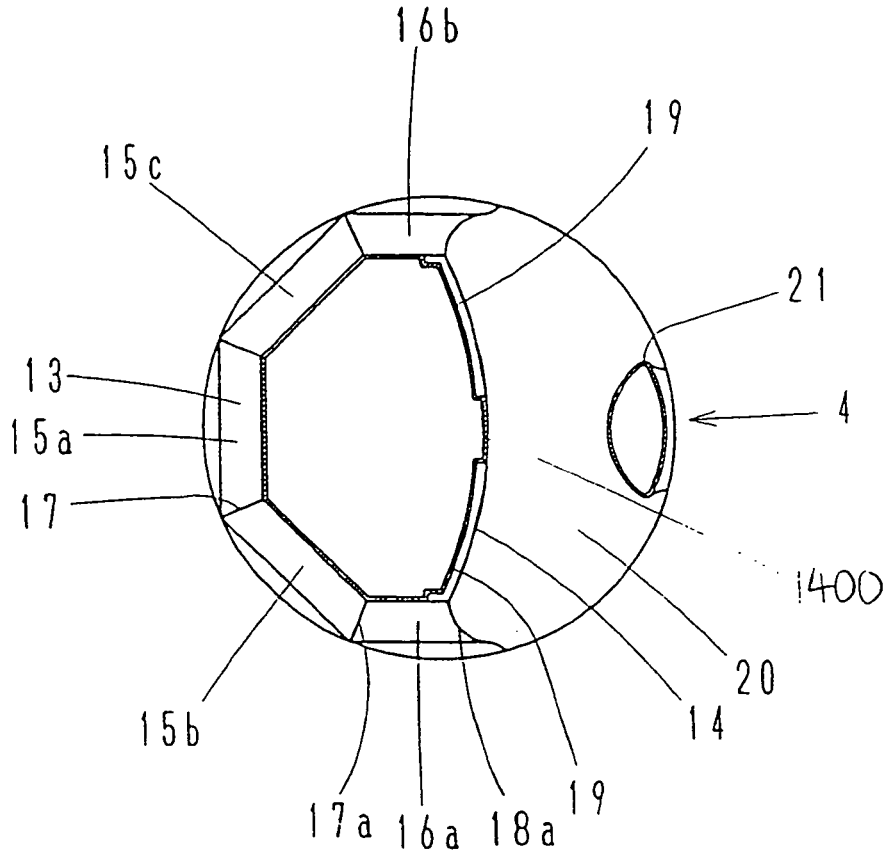
FIG. 5 is a cross sectional view along line A-A of FIG. 1.

At a center of the wall 14 in an axial direction of the bottle, lateral ribs 19, 19 are formed on both sides of a center portion 1400 (FIG. 5).

The wall 14 is connected with the bulged wall 11 to form a wall surface 20 connected to a right side portion of the lower body 8.

As illustrated in FIGS. 1, 2 and 3, facing to the wall 14, the handle 4 is extended from the shoulder 9 and the upper end of the wall 14 to the wall surface 20 provided at a periphery of the wall 11. In the illustrated embodiment, the handle 4 is integrally formed with the upper body 7 of the bottle. As shown in FIG. 5 throughout figures, the horizontal cross section of the handle 4 is formed in an arch shape having different radius dimensioned inside and outside.

At a middle of the longitudinal direction, the handle 4 is formed with a middle bulged portion 21 having a large width. An outer surface of the middle bulged portion 21 is formed with a stepped wall 22 which has a crescent shape from the right side view.

Since the handle has the wide bulged portion at the middle of the longitudinal direction, when the bottle is formed by oriented blow-molding, the middle bulged portion 21 is largely oriented. Thus, the middle bulged portion 21 is formed to be somewhat thin, so that it can be easily bent.

A downward rib 23 is formed between an upper end of the handle 4 and the curved wall 14.

As shown in FIGS. 1 and 2, the lower body 8 comprises a cylindrical wall 30 and a bottom circumferential wall 31. The cylindrical wall 30 has a circular cross sectional shape, and is adjacent to the bulged circumferential wall 11 via a step. The bottom circumferential wall 31 has a greater diameter than the cylindrical wall 30.

As illustrated in FIG. 1, a front surface of the cylindrical wall 30 is formed with a longitudinal rib 32 downwardly extending from an upper end of the wall 30.

A rear surface of the cylindrical wall 30 is also provided with a longitudinal rib at opposite to the longitudinal rib 32 in a radius direction. The cylindrical wall 30 is also provided with inclined ribs 33*a*, 33*b* extending downwardly and laterally from a point spaced apart from a lower end of the longitudinal rib 32. Each of the inclined ribs 33*a*, 33*b* extends to the bottom circumferential wall 31.

A right side circumferential surface 30*b* of the cylindrical wall 30 is formed with an arcuate rib 34. The rib 34 connects an upper end of the longitudinal rib 32 provided on the front surface to an upper end of the longitudinal rib provided on the rear surface. The rib 34 has an arch shape of which bottom end coincides with a center line of the right side circumferential surface. The right side wall 30 is formed with a lateral rib 35 spaced from the lower ends of longitudinal ribs 32*a*, 32*b*.

In the illustrated embodiment, a left side wall surface 30*a* and a right side wall surface 30*b* are respectively formed with wide concave grooves 36 vertically with same intervals.

Figure 6:
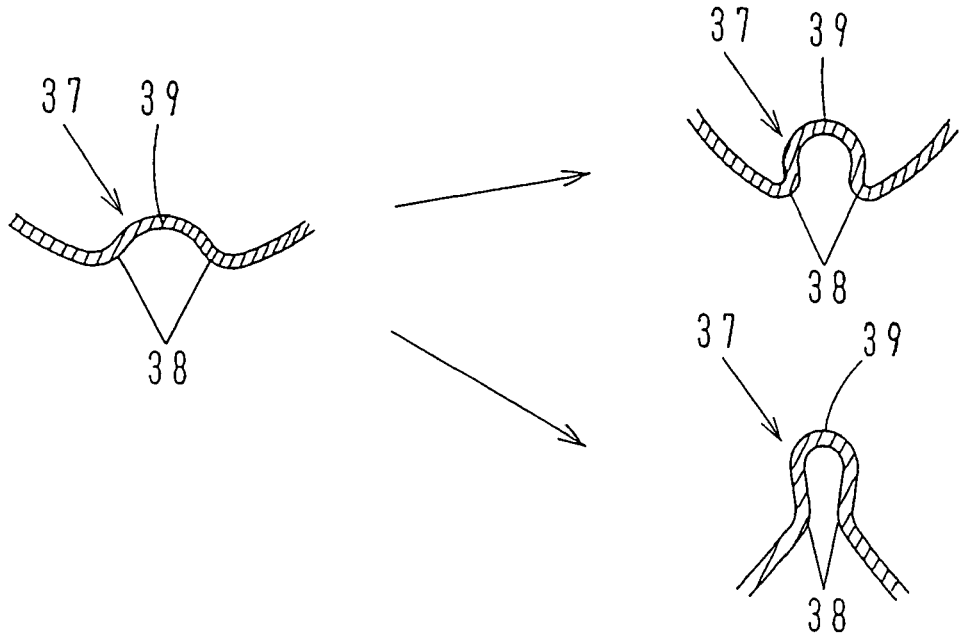
FIG. 6 is an enlarged cross section view of the a bending rib.

As shown in FIG. 6, each of the lateral ribs 19, 35, the longitudinal rib 32, the inclined ribs 33*a*, 33*b*, the downward rib 23 and the arcuate rib 34 is a concave rib having an arch shaped cross section, and acts as a bending rib 37 for squeezing and deforming the bottle.

In case of squeezing and deforming the bottle, the bottle is not bent along a longitudinal direction of the rib, while the rib is deformed along a cross direction thereof, and a connecting portion 38 between the rib and the wall of the bottle is bent. Thus, the wall of the bottle is bent at both sides of the rib, while the bending rib 37 acts as a bending line.

When the bottle is largely bent, plastic deformation occurs beyond elastic deformation at the connecting portion 38 or at a bottom 39 of the rib, so as to keep a deformed form of the bottle.

Although the bending rib 37 is a concave rib in the illustrated embodiment, a protruded rib may be used.

Figure 4:
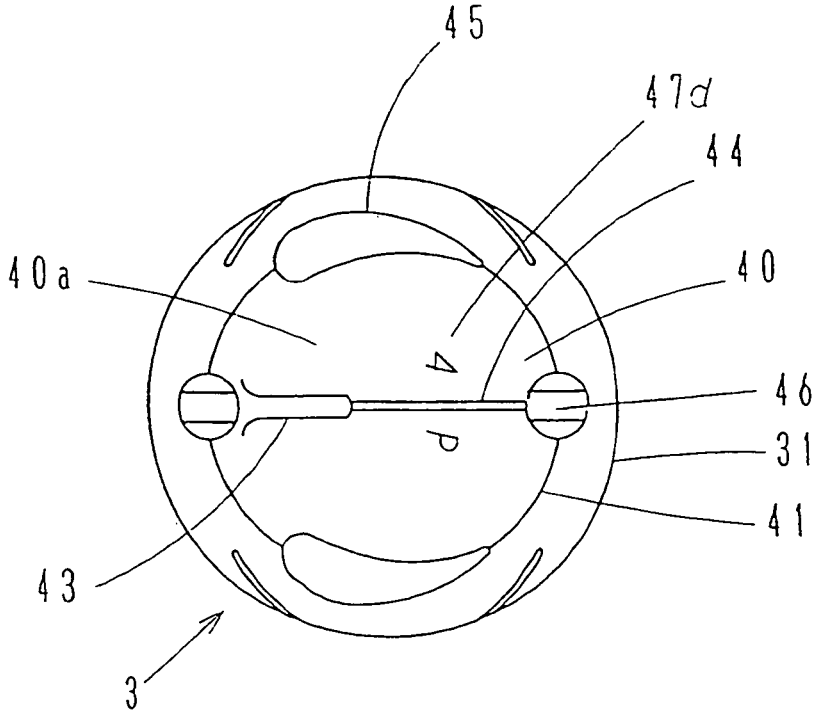
FIG. 4 is a bottom view of the bottle shown in FIG. 1.
Figure 7:
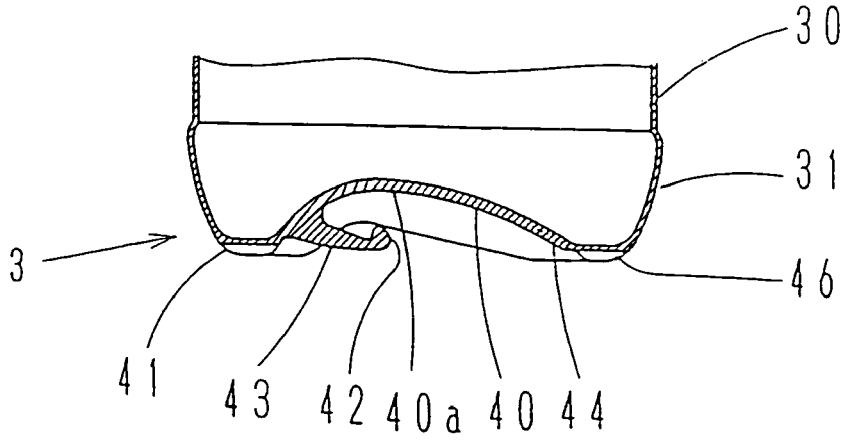
FIG. 7 is a vertical cross section view of the bottom of the bottle.

As illustrated in FIGS. 4 and 7, the bottom 3 of the bottle comprises a bottom wall 40 and a bottom end wall 41 which is provided at a periphery of the wall 40 and connects to the bottom circumferential wall 31 of the body 2 of the bottle. The bottom wall 40 includes a most depressed portion 40*a* which coincides with a parting line, and is positioned left side from a center of the parting line. The bottom wall 40 is formed by a curved wall extend from the most depressed portion 40*a* to the bottom end wall 41.

The bottom wall 40 is provided with a hanging piece 43 extending laterally along the parting line. The hanging piece 43 is formed with a hook 42 protruding inwardly at an end of the hanging piece.

The hanging piece 43 is provided near the bottom end wall 41 at a root portion thereof. The hook 42 is provided below the most depressed portion 40*a*.

A strip 44 is formed on the bottom wall 40, and extends from the root portion of the hanging piece 43 along the parting line, so as to reinforce the bottom wall 40.

Recessed portions 45 are formed on the bottom end wall 41 at front and rear opposite positions relating to the parting line. Notches 46 are oppositely provided along the parting line.

A way of squeezing the bottle will be described hereinbelow.

A bottle can be effectively squeezed if the bottle is put on a table in a manner a handle on the right side of the bottle is faced upward (when the bottle is put on the table, the "right" and "left" of the bottle side becomes "up" and "down", and the "front" and "rear" side of the bottle becomes the "left" and "right" side respectively, however each previous direction will be referred hereinafter).

In summary, the bottle is squeezed by pressing the body 2 or the neck 1 by a hand first so as to bend the middle portion of the handle 4.

Next, an upper portion of the lower body 8 is pressed inwardly and then a lower portion thereof is pressed inwardly, so as to bend the left and right walls of the lower body wall 8 at the longitudinal rib 32 as a bending line, to deform and depress the left and right circumferential walls, so that the circumferential wall 10 of the upper body 7 is deformed and depressed.

Then, the bottom 3 of the bottle is folded to obtain a flattened waste bottle.

Further, the flattened waste bottle may be bent, and the hanging piece 43 with the hook 42 may be engaged with upper edge of the neck 1, so that the waste bottle can be further deformed and depressed.

Next, the following is an explanation of indications showing an order of the operation for squeezing the bottle, which are formed at the predetermined place.

As shown in FIG. 2, an indication 47*a* "1 Push" is formed on an outer surface above the stepped wall 22 of the middle bulged portion 21 of the handle 4. In FIG. 2, the indication is illustrated as "1 P".

An indication 47*b* of "2 Push" is formed on the cylindrical wall 30 above the arcuate rib 34. An indication 47*c* of "3 Push" is formed on the cylindrical wall 30 above the lateral rib 35.

On the bottom wall 40, an indication 47*e* of "5 Bending Bottle" is formed as illustrated in FIG. 4.

Next, the order of squeezing and functions thereof will be detailed with reference to accompanied drawings.

The bottle neck 1 or the body 2 is held by a hand, and the indication 47*a* formed on the middle portion of the handle 4 in the longitudinal direction thereof is pressed inwardly.

Figure 8:
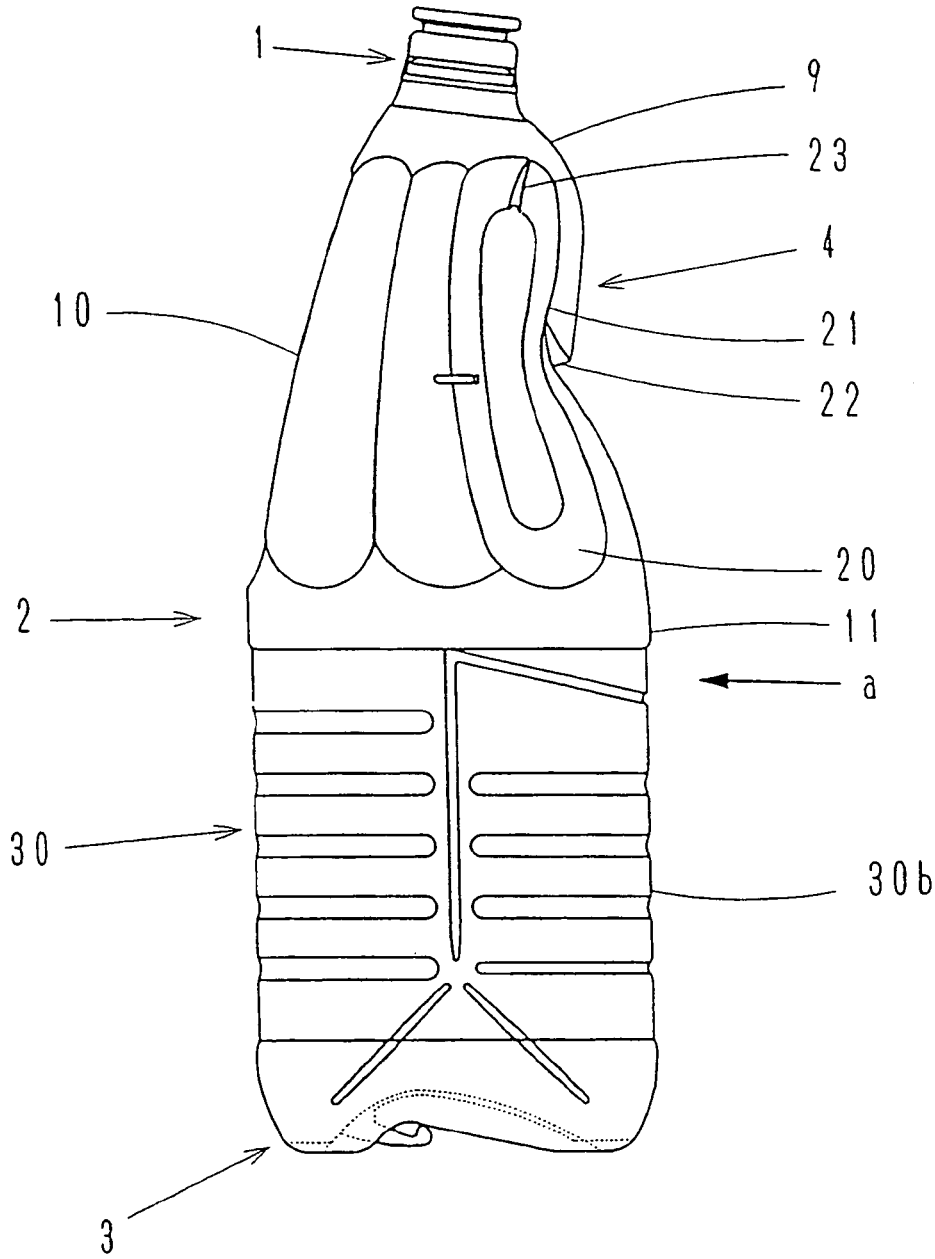
FIG. 8 is a front view in a state of the handle being bent.

When a bending force is applied to the handle 5, the handle 4 is bent along a bending line of the downward rib 23 as illustrated in FIG. 8, so that the handle is inwardly bent at a portion below the stepped wall 22 of the middle bulged portion 21.

At the same time, the upper body is pressed to be somewhat deformed partially.

Figure 9:
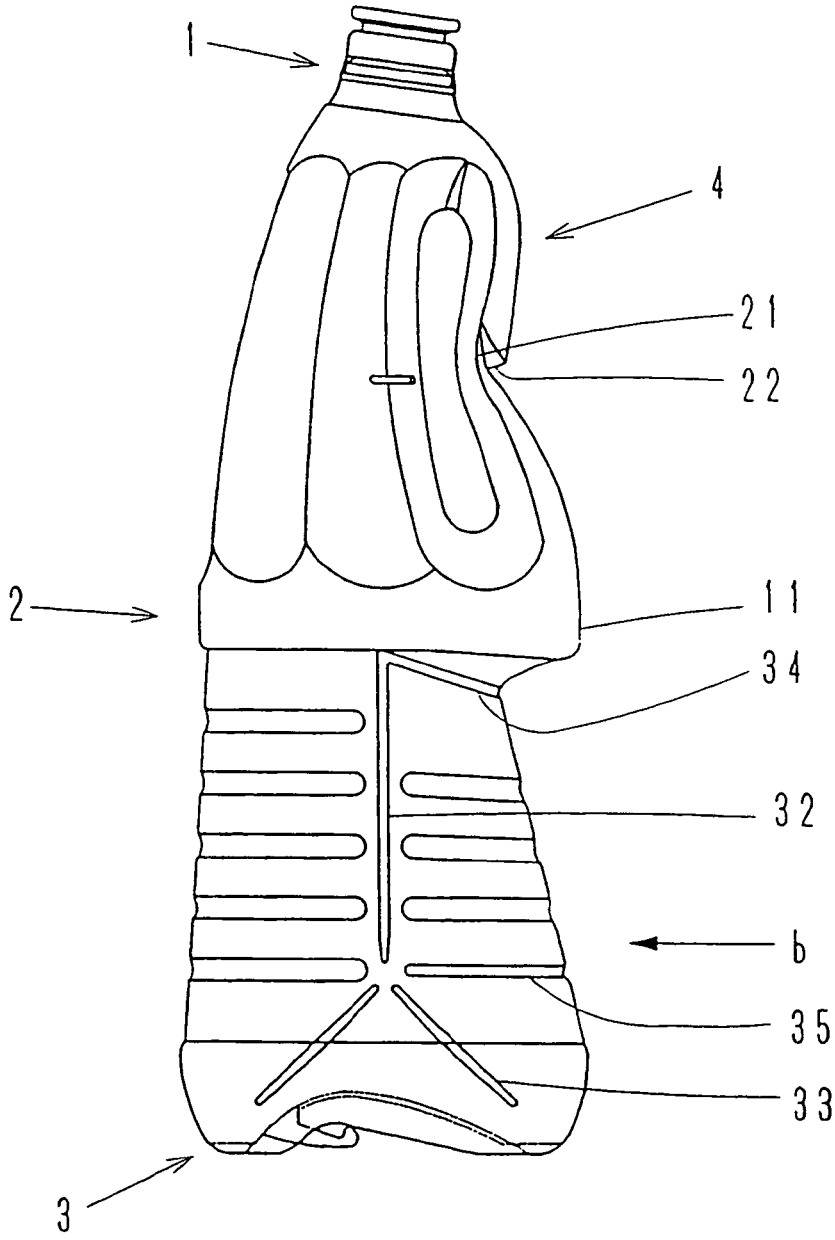
FIG. 9 is a front view of the bottle which an upper body is pressed.

Consequently, the indication 47*b* formed on the upper side of the cylindrical wall 30 is pressed inwardly (an arrow a illustrated in FIG. 8) to apply the bending force to both the bulged circumferential wall 11 and the right side circumference wall 30*b* of the body cylinder wall 30, so that as shown in FIG. 9, the right side wall 30*b* is bent along the bending line of the arcuate rib 34 to press the right side portion of the bulged wall 11 inwardly.

Figure 10:
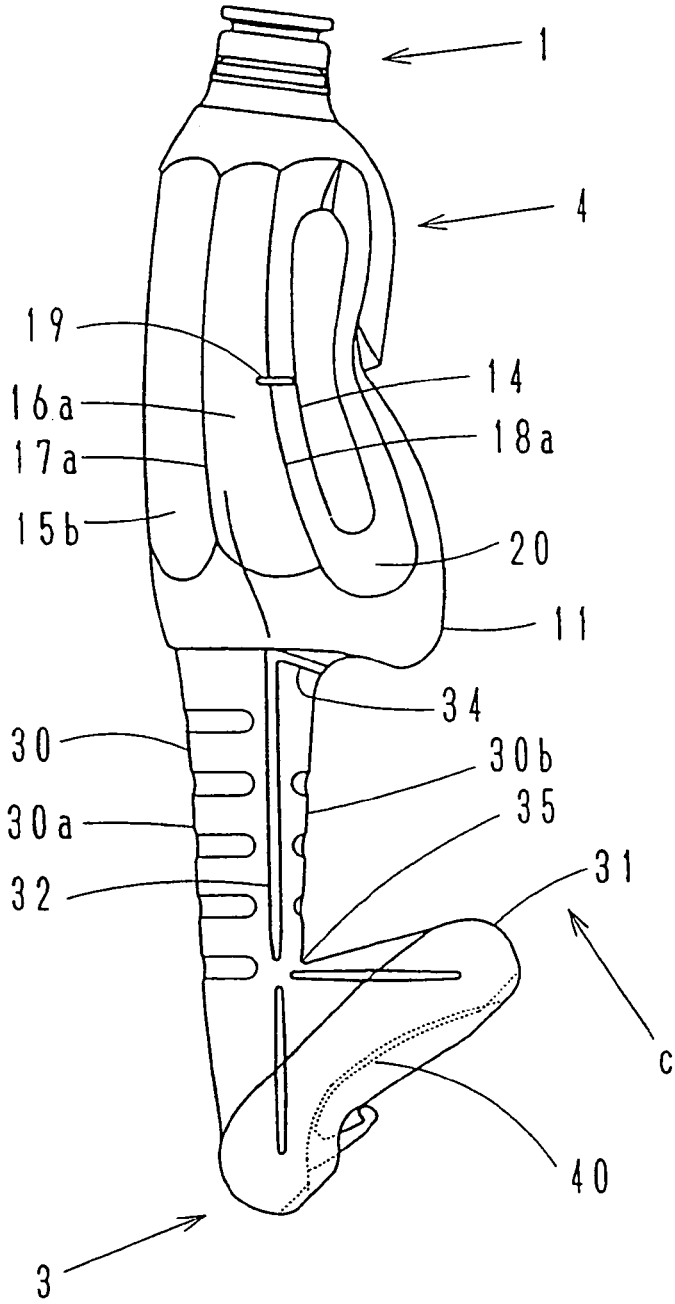
FIG. 10 is a front view of the bottle which a lower body is pressed.

Furthermore, when the indication 47*c* on the lower portion of the cylindrical wall 30 is pressed inwardly (an arrow b as shown in FIG. 9), the lower portion of the right side 30*b* is bent along the bending line of lateral rib 35, and the bottom circumference wall 31 is also bent along the lateral rib 35, as illustrated in FIG. 10.

Figure 12:
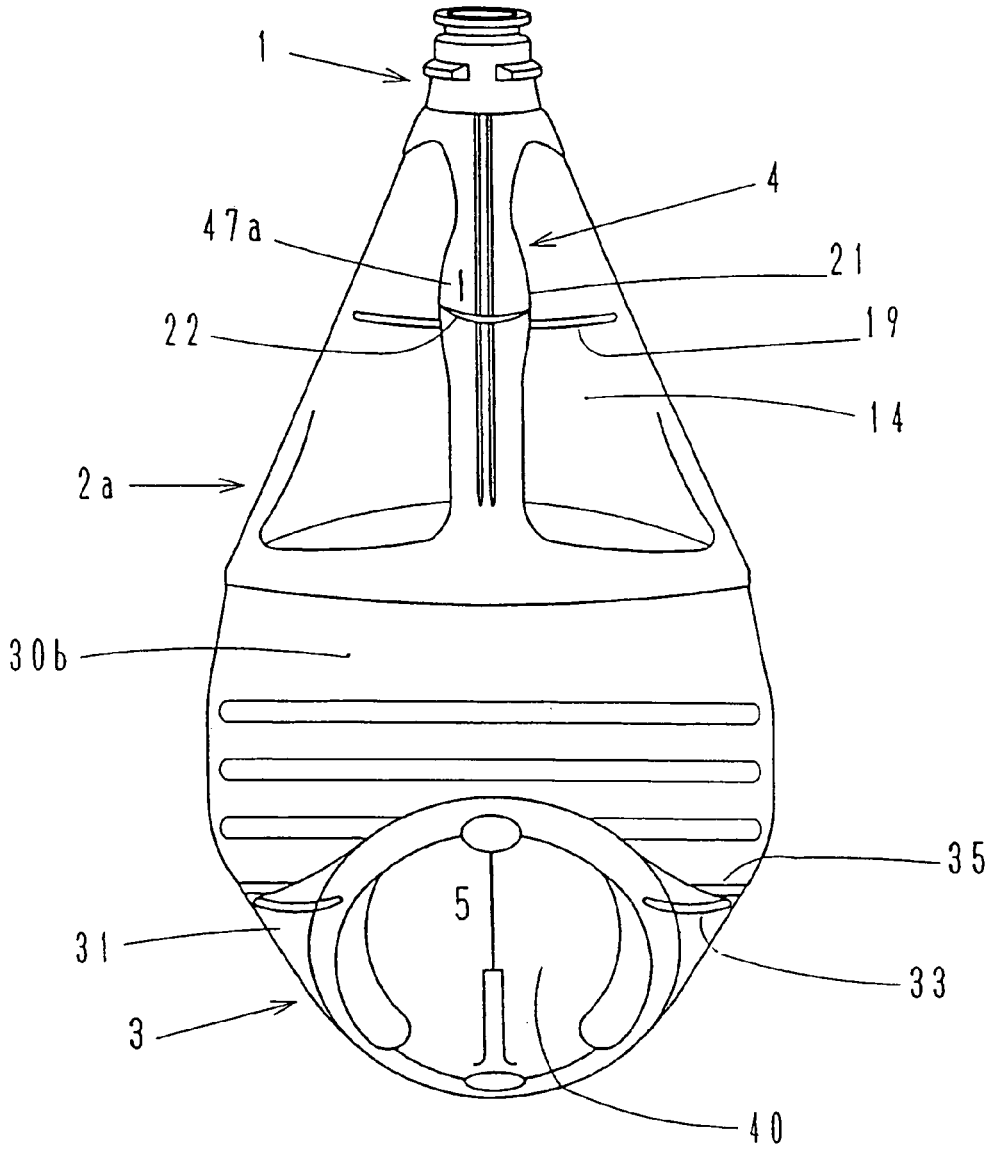
FIG. 12 is a right side view of the flattened bottle.
Figure 13:
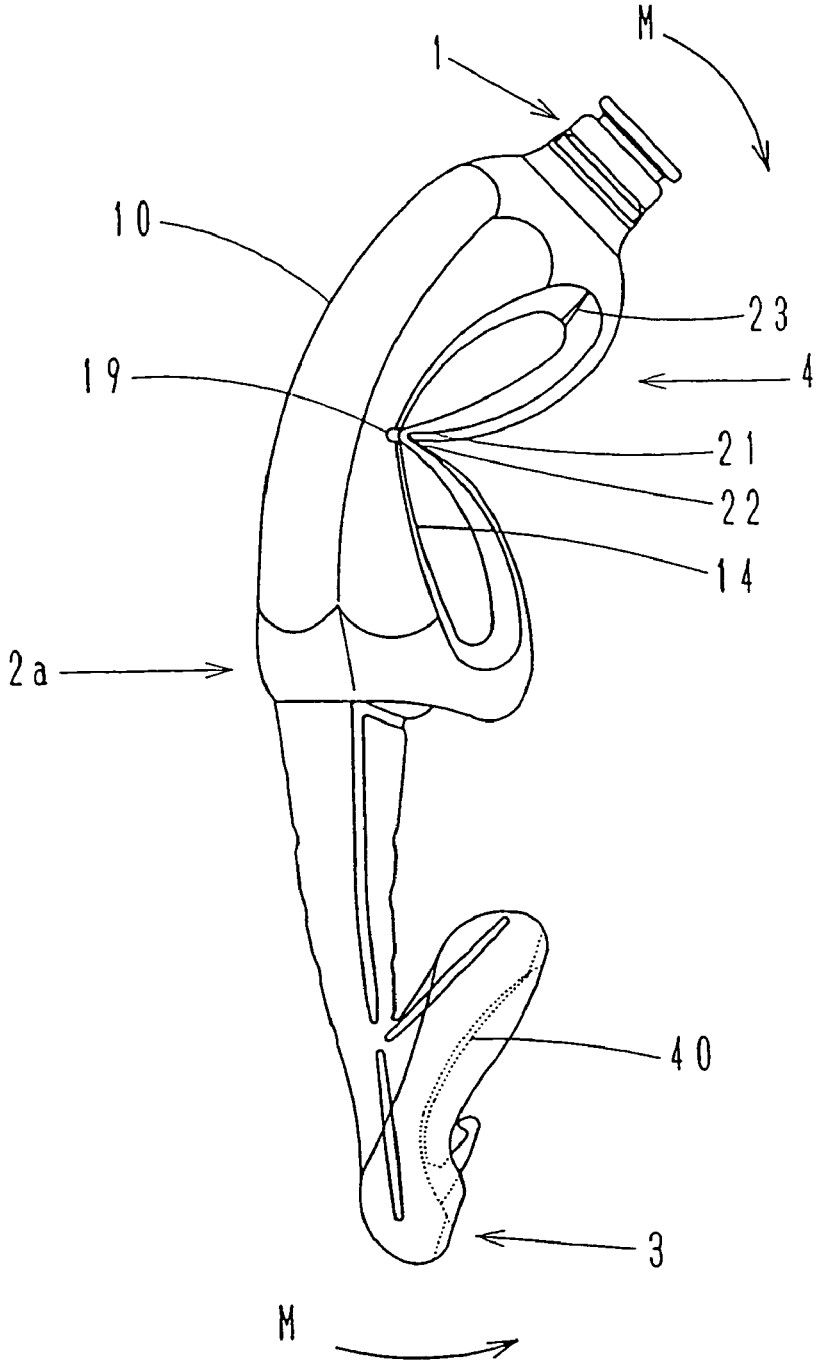
FIG. 13 is a front view in a state of a flat body of the bottle being bent.

Resultantly, the left and right side 30*a*, 30*b* of the cylindrical wall 30 are bent along the longitudinal rib 32 respectively, so that the cylindrical wall 30 can be flattened. In this case, the longitudinal ribs 32 and the vicinity thereof are protruded forwardly and backwardly (FIG. 12).

The flattening of body cylinder wall 30 will effect on the circumferential wall 10 of the upper body 7.

Each of the front side wall 16*a* and the rear side wall 16*b* is hardly bent circumeferentially, because the lateral rib 19 extends from the inwardly curved wall 14 to these walls 16*a*, 16*b*. Thus, the body circumference wall 10 is bent along the ridge line 17*a* between the front-left side wall 15*b* and the front side wall 16*a* and along the ridge line 17*b* between the rear-left side wall 15*c* and the rear side wall 16*b* as a bending line, so that the circumferential wall 10 deformed and protruded forwardly and rearwardly.

Next the indication 47*d* of the bottom 3 is pressed as shown by an arrow c in FIG. 10, so that the bottom 3 is bent along the lateral rib 35 of the right side circumferential wall 30*b*, so as to close the right side surface 30*b* and the right half portion of the bottom wall 31 more, and the bottom wall 40 is further bent.

Figure 11:
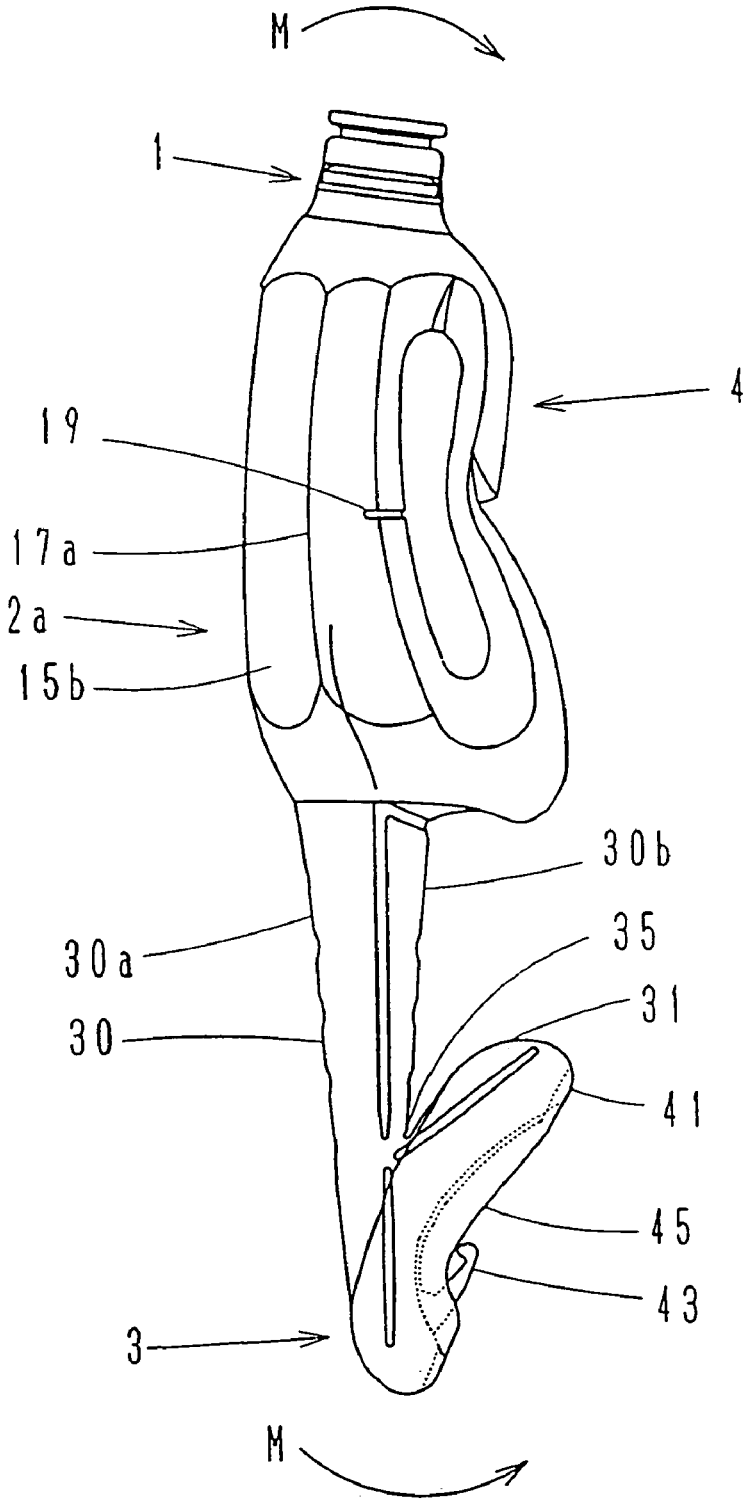
FIG. 11 is a front view of the flattened bottle.

The body 2 becomes a flattened body 2*a* as shown in FIGS. 11, 12 to obtain the flattened bottle for disposal.

In this case, the flattened manner can be maintained by a plastic deformation occurred around the bent, bulged and other portions.

Although the flattened bottle obtained as described above can be dumped or wasted, said flattened bottle for disposal may be further folded to obtain a smaller bottle.

The neck 1 and the bottom 3 are held by a hand, and a bending force M (FIG. 11) is applied, the bottom 3 is pressed by the flat body 2*a* to be further flattened, the circumferential wall 10 is bent along the bending line of the lateral rib 19, and the handle 4 is further bent accordingly.

The handle 4 is further bent at the downward rib 23 and the stepped wall 22. At the lower portion of the stepped wall 22, the width of the middle bulged portion 21 is further increased, and a plastic deformation occurs, so that the middle portion of the handle is further flattened. An inner surface of the stepped wall 22 contacts with the inwardly curved wall 14 of the circumferential wall 10.

The bending force M (FIG. 13) is further applied, the flat body 2*a* is further bent, so that thereby the bottom wall 40 contacts with the neck 1.

Figure 14:
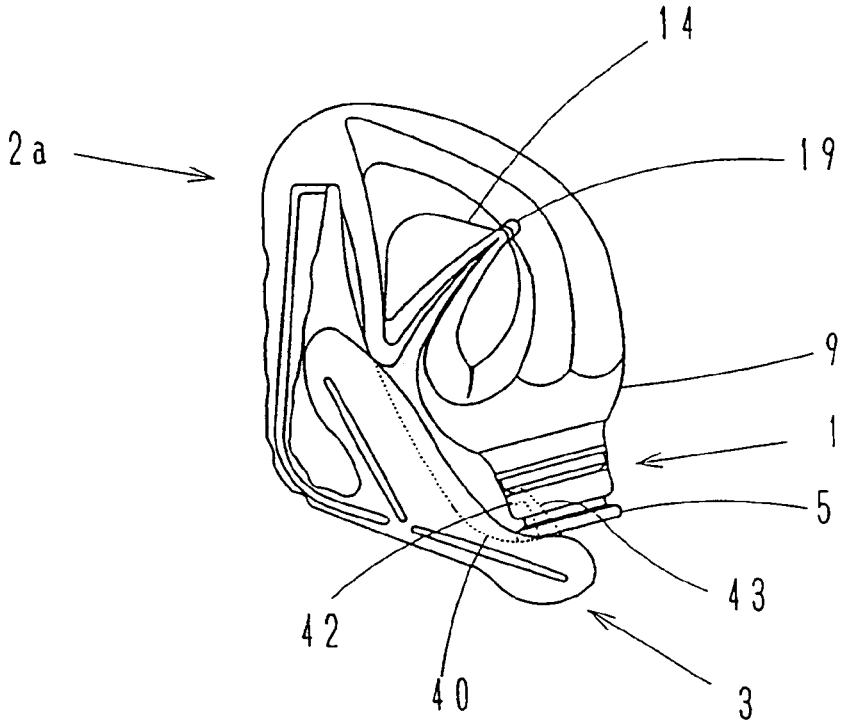
FIG. 14 is a front view of the bottle to be bent.

In this manner, the hook 42 of the hanging piece 43 on the bottom wall 40 is engaged to an inner surface of the neck 1, so that the neck 1 and the bottom 3 can be kept to be contact each other, so as to obtain the smaller bottle of the folded flat body 2*a* as shown in FIG. 14.

For flattening and squeezing the bottle, due to the plastic deformation of the flat body 2*a*, the body 2*a* is not recovered except of adding the external force. However, it may be considered that the plastic deformation does not occur at the bent flat body 2*a*. Thus, the neck 1 and the bottom 3 are engaged with each other to prevent the bent and folded flat body 2*a* from recovering when the bottle is dumped or wasted.

As described above, the waste bottle folded to be less quantity can be obtained.

When the bottle is arranged on the table in which the handle is positioned upwardly as described above, the bottle can be effectively squeezed by only pressing the right side of the bottle inwardly, because a reactive pressure is applied to the left side of the bottle. If the bottle is squeezed by grasping the bottle by both hands, the bottle can be squeezed by pressing from both sides in accordance with the order described hereinbefore.

In this case, the circumferential wall of the upper body together with the handle is pressed from both side so as to deform the upper body wall simultaneously with bending the handle.

Thereafter the lower body is squeezed. Alternately the lower body is pressed to deform at first, then the handle and the upper body may be pressed to deform.

Second Embodiment

The second embodiment will be described with reference to FIGS. 15 to 25. In the second embodiment, respective shape of the handle and the body, especially an arrangement of a bending and deformed portion of the handle and the bending rib of the body are altered.

Figure 15:
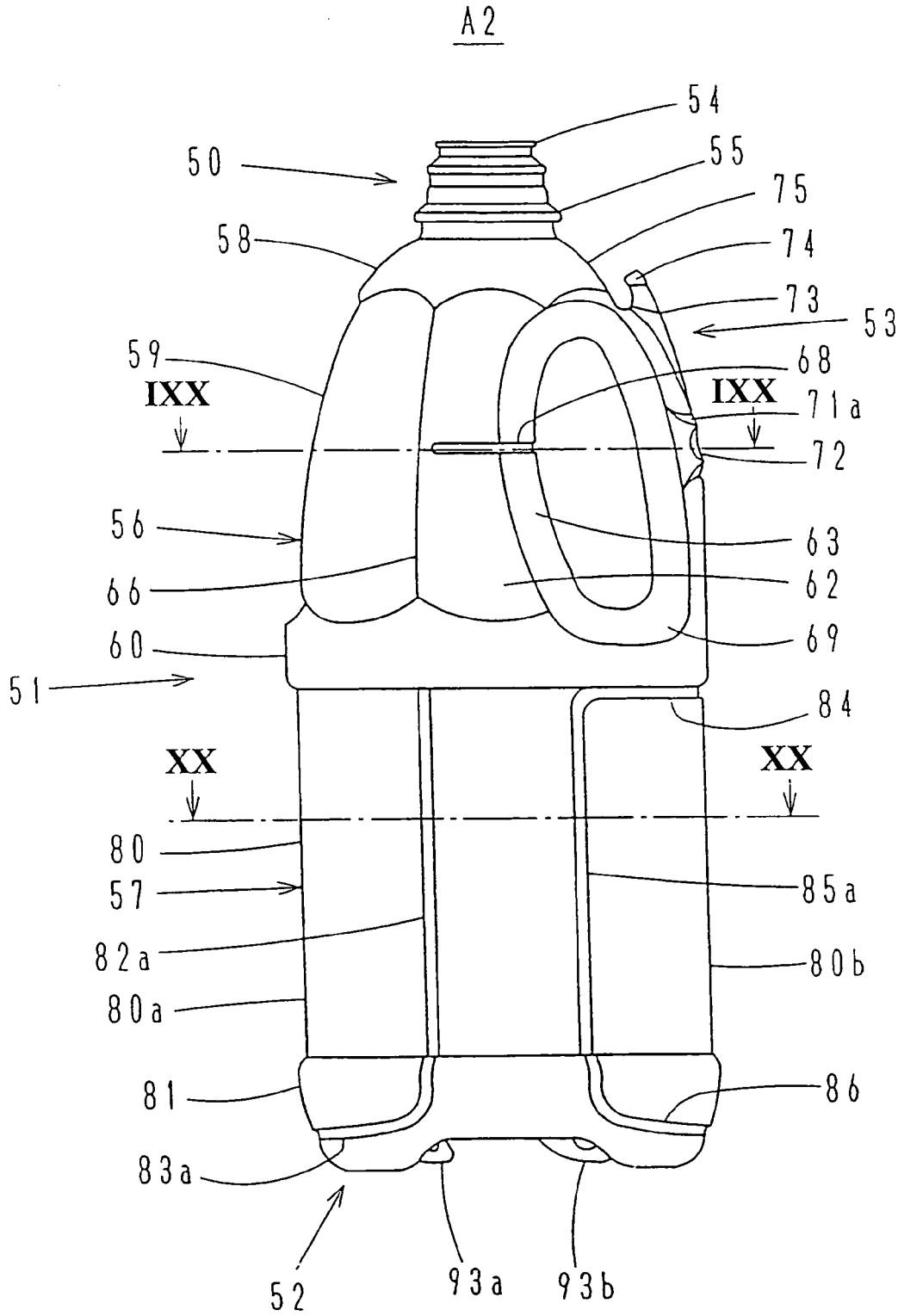
FIG. 15 is a front view of the bottle according to the second embodiment of the invention.
Figure 16:
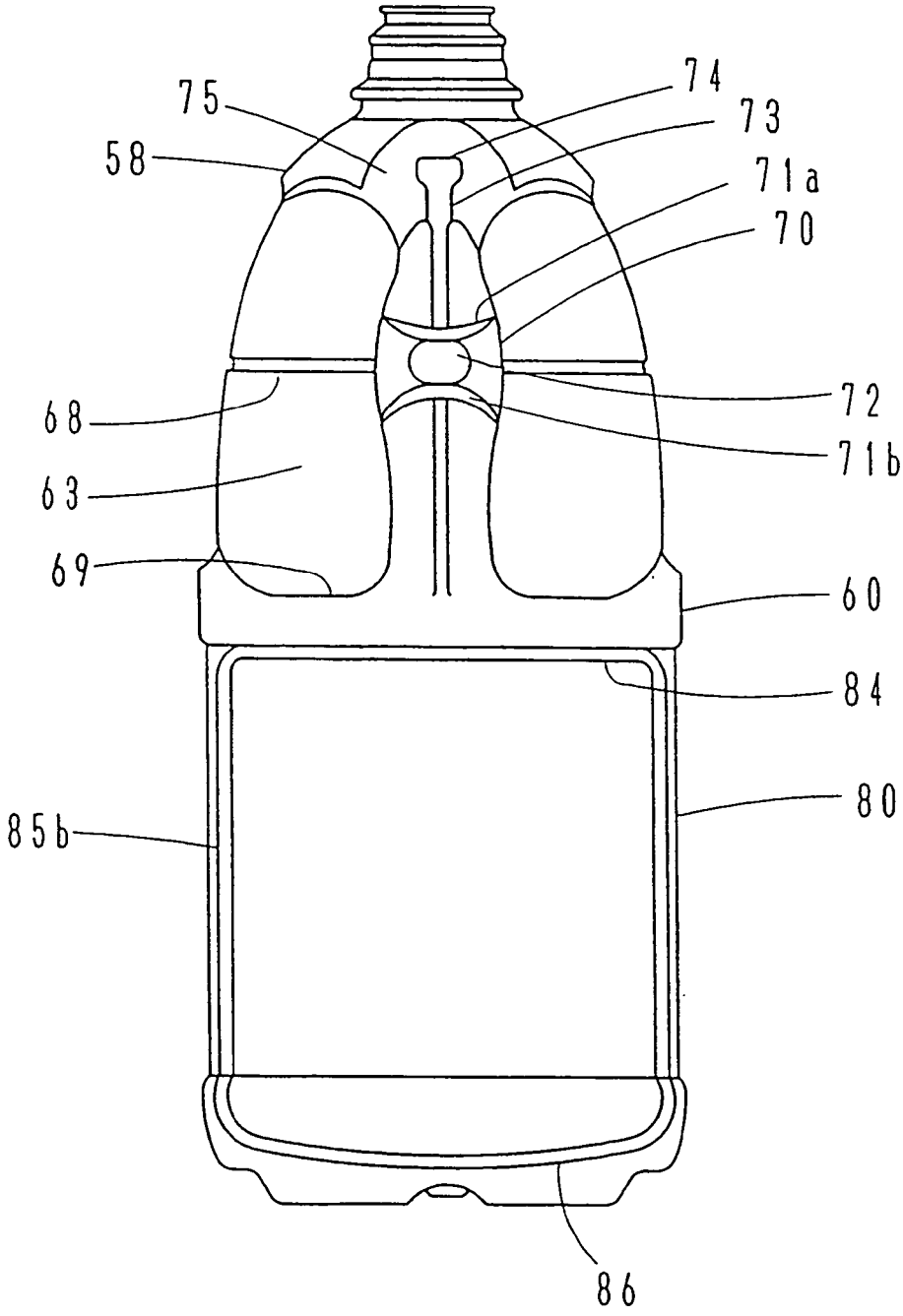
FIG. 16 is a right side view of the bottle shown in FIG. 15.

As shown in FIGS. 15 and 16, in the second embodiment, a bottle A2 comprises a neck 50, a body 51 and a bottom 52, and the body 51 includes a handle 53.

The bottle A2 is formed by blow molding polyolefins resin and other synthetic resins for example, and may be molded from a single layer synthetic resin or from multi-layered one.

A bulged collar or ring 54 and a holding protruded lip 55 are provided around an outer circumference of the neck 50.

The body 51 comprises an upper body 56 with the handle 53 and a lower body 57 having a circular cross sectional shape. The upper body 56 comprises a semi-spherical shoulder wall 58 connected to the neck 50, a circumferential wall 59 with a ridge-line adjacent to the wall 58, and a bulged circumference wall 60 having a circular cross sectional shape.

The circumferential wall 59 comprises a side wall 62 between the shoulder wall 58 and the bulged circumferential wall 60 and an inwardly curved wall 63 curved in an axis direction.

Figure 17:
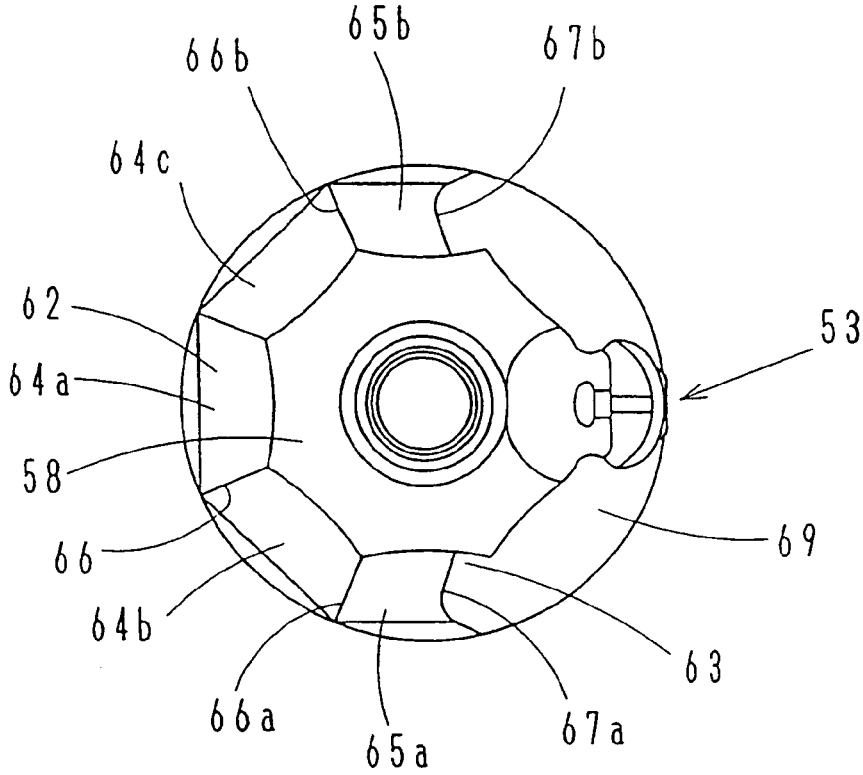
FIG. 17 is a plane view of the bottle shown in FIG. 15.

As shown in FIG. 17, the side wall 62 comprises a left side wall 64*a*, a front-left side walls 64*b* adjacent to the left side wall 64*a*, a rear-left side wall 64*c* adjacent to the left side wall 64*a*, a front wall 65*a*, and a rear wall 65*b*. The side wall 62 is formed by a slightly inwardly curved surface, and includes a ridge line 66 extending between a lower edge of the shoulder 58 and an upper edge of the bulged wall 60 (FIG. 15 and FIG. 17).

Figure 19:
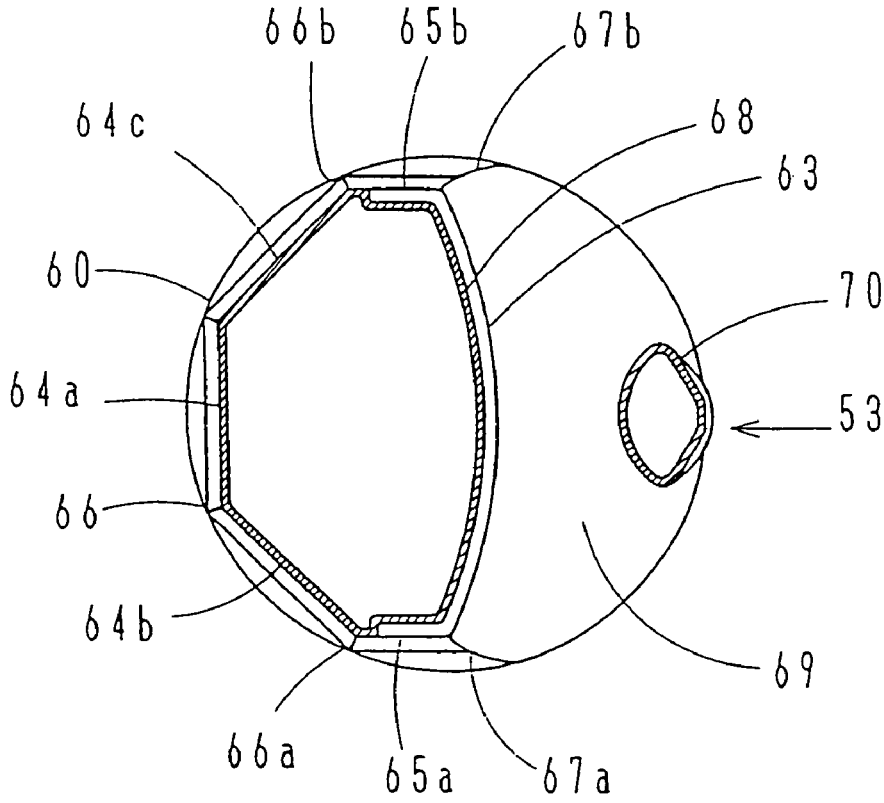
FIG. 19 is a cross sectional view along line A-A of FIG. 15.

The inwardly curved wall 63 is adjacent to the front wall 65*a* and the rear wall 65*b* through arcuate ridge-lines 67*a*, 67*b* and is formed from curved surfaces as well as the first embodiment. At a vertical middle portion of a longitudinal direction of the inwardly curved wall 63, a lateral rib 68 is formed to extend to the front wall 65*a* and the rear wall 65*b* (FIGS. 15, 16 and 19).

As shown in FIGS. 15 to 17, as well as the first embodiment, facing to the inwardly curved wall 63, the handle 53 is extended from the shoulder 58 and the upper end of the inwardly curved wall 63 to a wall surface 69 provided at a periphery of the bulged circumferential wall 60. In the illustrated embodiment, the handle 53 is integrally formed with the upper body 56. As shown in FIG. 19, the handle 53 is formed its inside an arcuate cross section.

At a middle of the longitudinal direction, the handle 53 is formed with a middle bulged portion 70 having a wide width. An outer surface of the middle bulged portion 70 is formed with stepped walls 71*a*, 71*b* with vertical intervals. The outer surface of the handle between walls 71*a* and 71*b* is protruded.

A concave portion 72 is formed to depress from the protruded surface between the stepped walls 71*a*, 71*b*.

The handle 53 is provided with an engaging piece 73 extending upwardly. The engaging piece 73 is provided at an upper end thereof with a hook 74 protruded inwardly.

The shoulder wall 58 is formed with a flat portion 75 at a portion facing to the engaging piece 73.

As well as the first embodiment, the lower body 57 is adjacent to the bulged circumferential wall 60, and comprises a cylindrical wall 80 having a circular cross section and a bottom circumferential wall 81 having a greater diameter than the cylindrical wall 80.

Two longitudinal ribs 82*a*, 82*b* are formed on a left side circumferential surface 80*a* of the cylindrical wall 80. Each of the longitudinal ribs extends to the bottom circumferential wall 81. On the bottom wall 81, arcuate lateral rib 83 is formed which connect respective lower end of the longitudinal ribs with each other.

On a right side circumferential surface 80*b* of the cylindrical wall 80, a lateral rib 84 is formed adjacent to the bulged wall 60. Longitudinal ribs 85*a*, 85*b* are downwardly extended from both ends of the lateral rib 84.

Each of the longitudinal ribs 85*a*, 85*b* extends to the bottom circumferential wall 81. An arcuate lateral rib 86 is formed on the bottom wall 81 to connect with lower ends of the longitudinal ribs.

Figure 20:
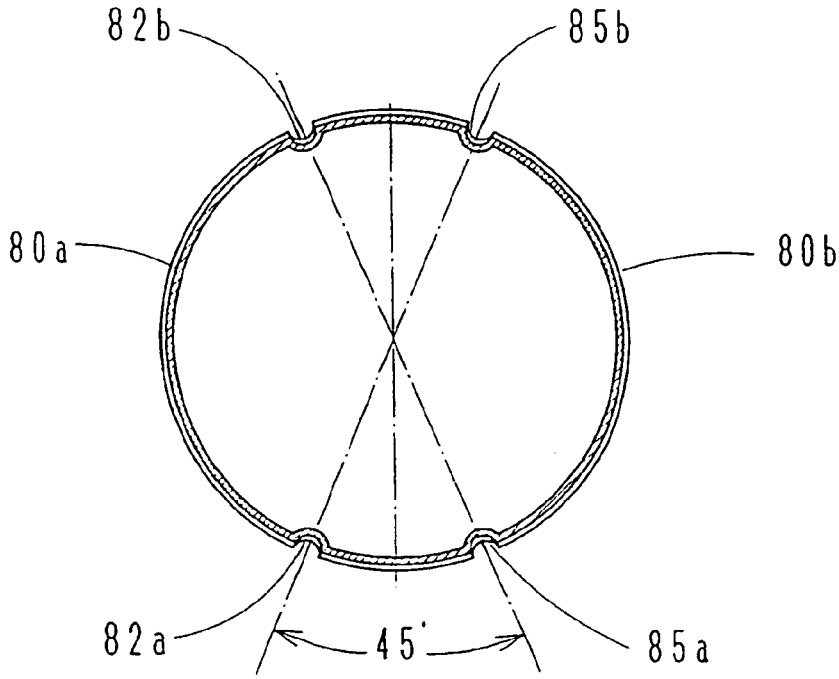
FIG. 20 is a cross sectional view along line B-B of FIG. 15.

As shown in FIG. 20, the longitudinal ribs 82*a*, 82*b*, 85*a*, 85*b* are symmetrically arranged from a center line with having an angle of 45° respectively. Each of ridge lines 66*a*, 66*b* of the front and rear walls 65*a*, 65*b* coincides with each of the longitudinal ribs 82*a*, 82*b*.

Each of the lateral ribs 68, 83, 84, 86 and the longitudinal ribs 82, 85 is a concave rib and acts as a bending rib, as well as described in the first embodiment.

Figure 18:
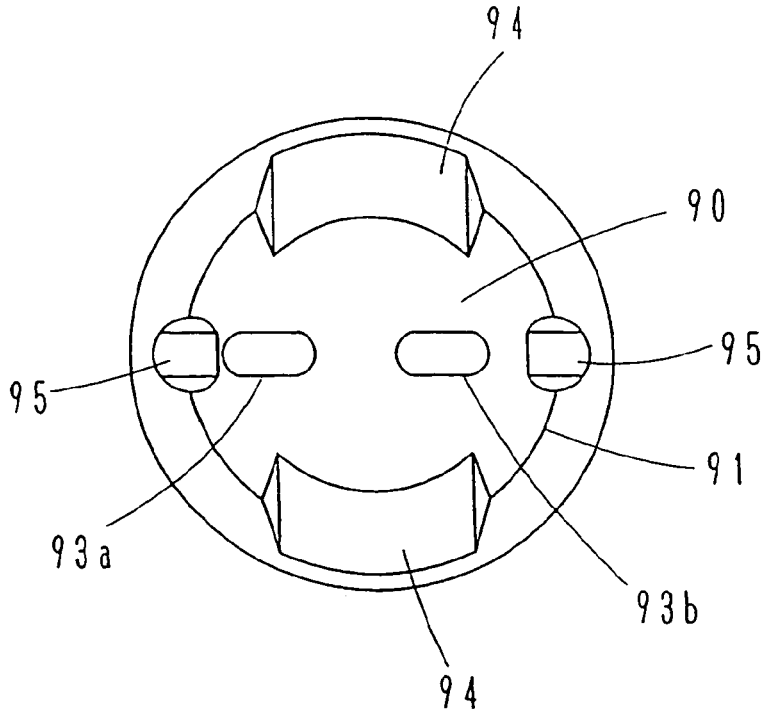
FIG. 18 is a bottom view of the bottle shown in FIG. 15.
Figure 21:
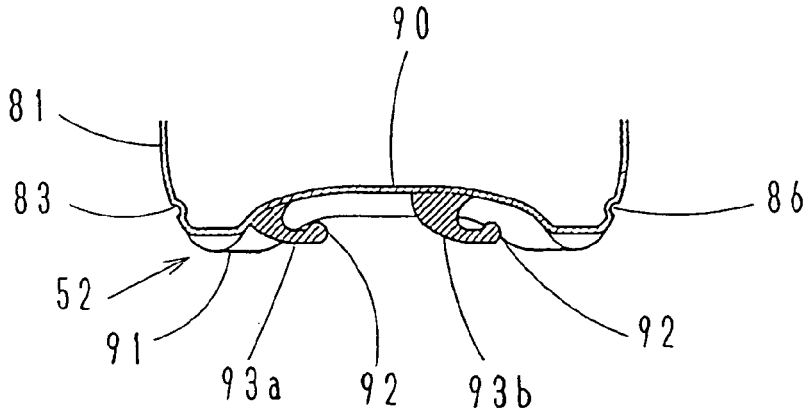
FIG. 21 is a longitudinal sectional view of the bottle bottom.

As shown in FIGS. 18 and 21, the bottom 52 comprises a bottom wall 90 and a bottom end wall 91 which is provided at a periphery of the bottom wall 90 and connects with the bottom wall 81 of the body 51. Two hanging pieces 93*a*, 93*b* are formed on the bottom wall 90 along a parting line. Each of the hanging piece 93*a*, 93*b* is provided at its end with a hook 92 protruding inwardly.

The bottom end wall 41 is provided with recessed portions 94 at front and rear opposite positions with respect to the parting line, and notches 95 on the parting line.

A method of squeezing the bottle will be described hereinbelow.

The way of squeezing is summarized herewith. The body 51 is pressed inwardly to reverse or invert the wall to decrease the volume of the bottle. Then, the body 51 is squeezed to form a flat body 51*a*, the handle 53 is also squeezed, and then the bottom is bent to obtain the flattened bottle for disposal.

Further, the flattened upper body 56 may be bent on the lateral rib 68, the flattened body 51*a* may be bent so as to contact the neck 50 with the bottom 52, and finally one of the hooks 92 of hanging pieces 93*a*, 93*b* of the bottom wall 90 may be engaged with the neck 50 or the hook 74 of the handle 53, to obtain a smaller flattened bottle for disposal.

Next, the function or effect of squeezing the bottle will be described with reference to accompanied drawings.

Figure 22:
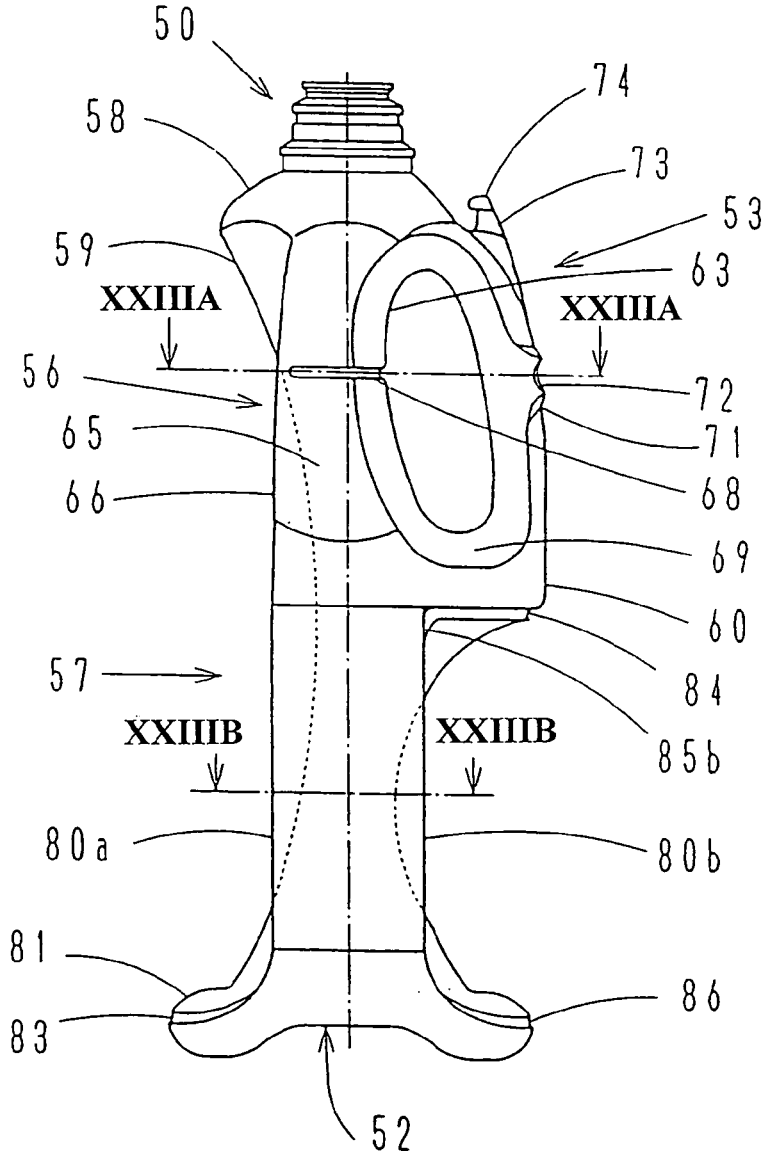
FIG. 22 is a front view of the reversely deformed bottle.
Figure 23A:
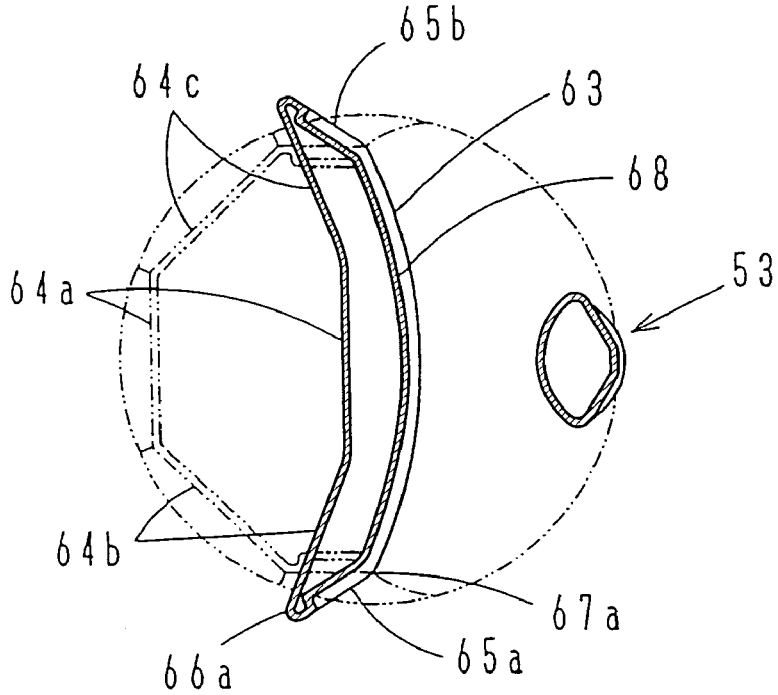
FIG. 23 is a cross section view of the reversely deformed bottle, in which (a) is a cross sectional view thereof along line A-A of FIG. 22, and (b) is a cross sectional view thereof along line B-B of FIG. 22.
Figure 23B:
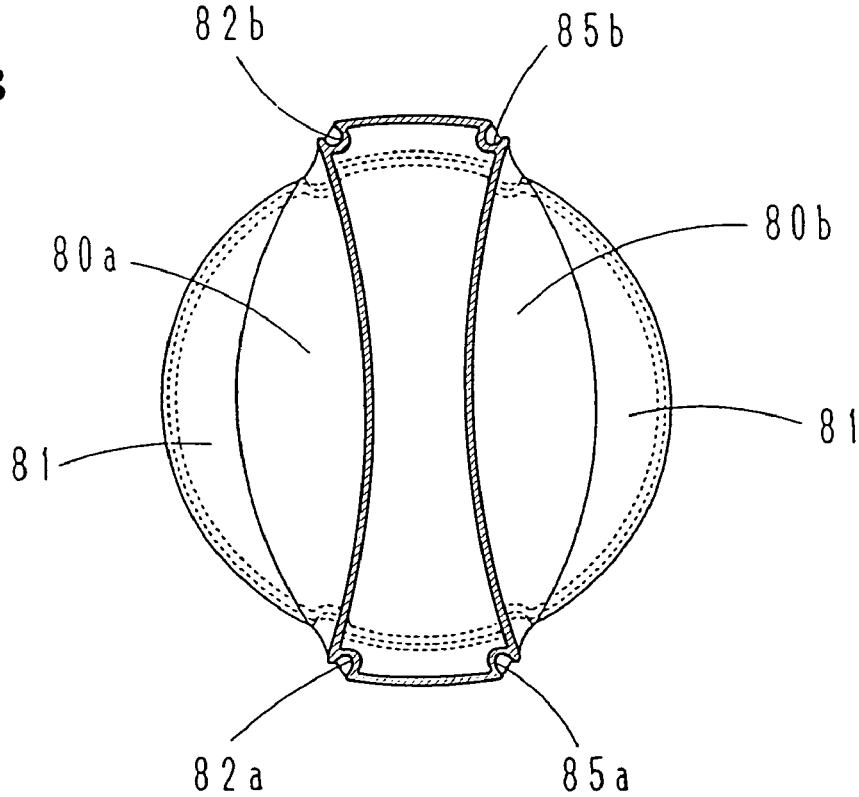

When the cylindrical wall 80 of the lower body 57 is pressed inwardly, the left side circumferential wall 80*a* is reversed or inwardly deformed around the longitudinal ribs 82*a*, 82*b* as shown in FIGS. 22 and 23 (*b*), and the left side wall of the bottom circumferential wall 81 is bent along the folding line of lateral rib 83.

The right side circumferential wall 80*b* of the cylindrical wall 80 is reversed inwardly around the lateral rib 84 and the longitudinal ribs 85*a*, 85*b*. The right side of the bottom circumferential wall 81 is bent along the folding line of the lateral rib 86.

When the circumferential wall 59 of the upper body 56 is pressed inwardly, the side wall 62 is reversed or inwardly deformed around the ridge lines 66*a*, 66*b*, and the bulged circumferential wall 60 is also reversed around an axis coinciding with the longitudinal rib 82*a* and the ridge line 66*a* and around an axis coinciding with the longitudinal rib 82*b* and the ridge line 66*b*.

In this case, the deformation of the left side circumferential wall 80*a* of the lower body 57 causes the reversion of the left side wall of the upper body 56 to be easily.

The thus obtained bottle is deformed in a manner illustrated by FIGS. 22 and 23.

When the lower body 57 as illustrated in FIG. 22 is pressed inwardly from left and right sides, the cylindrical wall 80 of the lower body 57 is also bent along a folding line vertically extending between the longitudinal ribs 82*a* and 82*b*, thereby to protrude forwardly and rearwardly directions, so as to flatten the cylindrical wall 80.

Next, the circumferential wall 59 of the upper body portion 56 is pressed inwardly from left and right sides. Since the front wall 65*a* and the rear wall 65*b* includes the lateral rib 68 extending to the curved wall 63, the front wall 65*a* and the rear wall 65*b* cannot be bent. Therefore, the circumferential wall 59 is bent around the folding line of the ridge lines 66*a*, 66*b* to protrude forwardly and rearwardly. Since a lower portion of the circumferential wall 59 is affected by effected by the bending and protruding of the lower body 57, the deformed circumferential wall 59 forms a curve line connecting with the protruded lower body 57.

In this case, plastic deformation occurs at the bent, protruded portions and on other portions so as to keep the bottle in a flattened manner.

Figure 24:
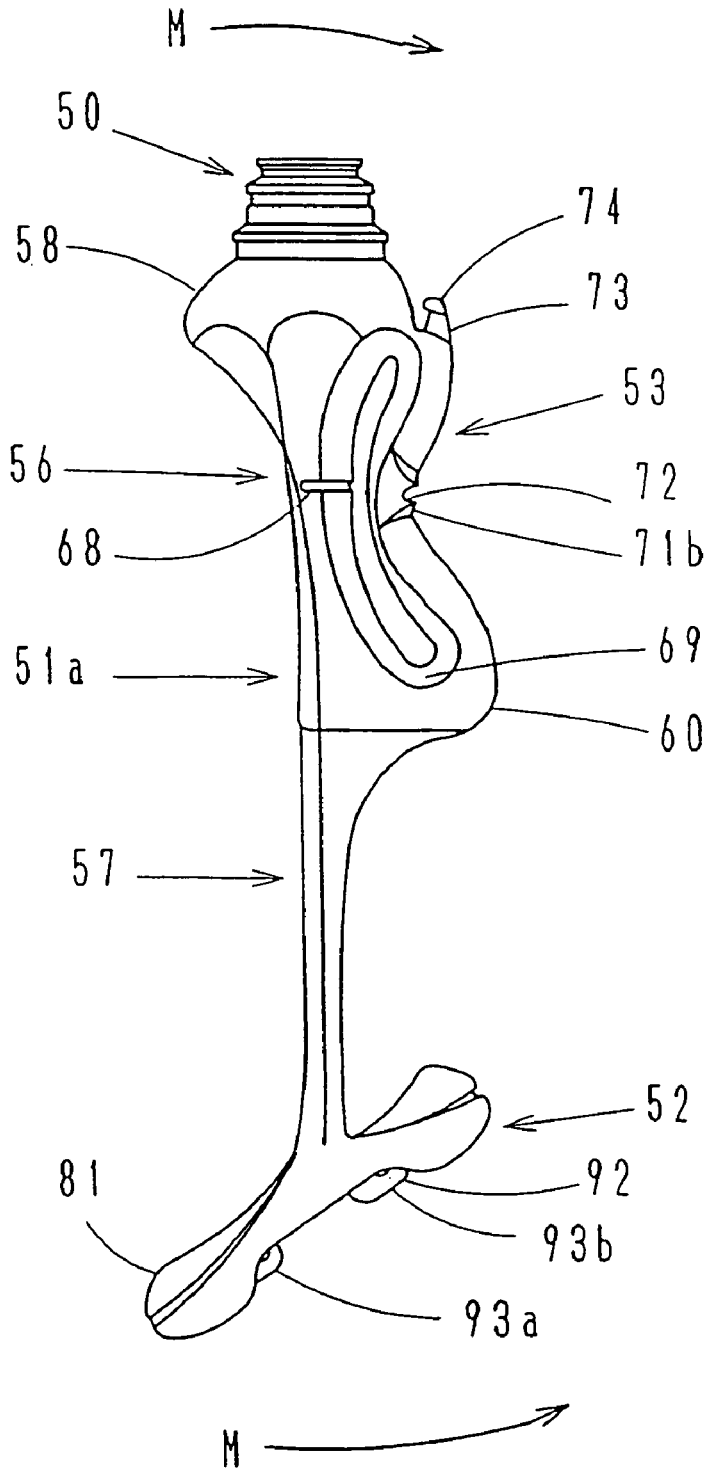
FIG. 24 is a front view of the flattened bottle.

Next, the neck 50 or the bulged circumferential wall 60 is grasped and a bending force is applied to the handle 53. The handle 53 is bent around the concave portion 72 of the middle bulged portion 70 or around the stepped wall 71*b*, as illustrated in FIG. 24.

At that time, the right side circumferential wall of the bulged circumferential wall 60 is difficult to deform due to the presence of the wall surface 69. However, the bent handle 53 causes the right side wall of the bulged circumferential wall 60 to be pulled upwardly, the bulged circumferential wall 60 is largely deformed together with the deformation of the circumferential wall 59 and the left side wall 80*a* of the cylindrical wall 80.

As a result of the described above, the volume of the upper body 56 is decreased and the lower body 57 is flattened, so that the body 51 is deformed to a flat body 51*a*.

Since the neck 50 and the shoulder 58 are thick, they are not deformed.

Next, the bending force is applied to the bottom 52 to bend it toward the flat body 51*a* to deform the bottle as shown in FIG. 24, thereby the flattened bottle for disposal can be obtained.

The thus obtained flattened bottle for disposal may be further folded. When the bending force M is applied to the neck 50 and the bottom 52 illustrated in FIG. 24, the front wall 65*a*, the rear wall 65*b* and the curved wall 63 are bent around the folding line of the lateral rib 63, so that the circumferential wall 59 of the upper body 56 is bent furthermore. Then the bending force M is further applied, the flat body 51*a* is bent, so that the neck 50 contacts with the bottom wall 90.

Figure 25A:
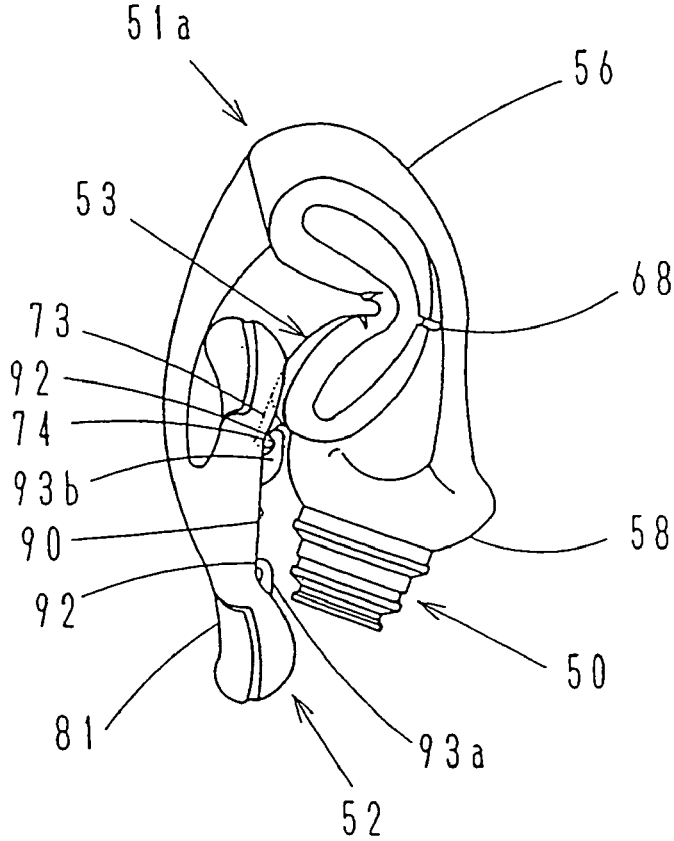
FIG. 25 is a front view of the bottle to be bent, in which (a) is an explanatory view of the engaging piece of the bottom being engaged with the engaging piece of the handle, and (b) is a view of the other engaging piece of the bottom being engaged with the neck of the bottom.
Figure 25B:
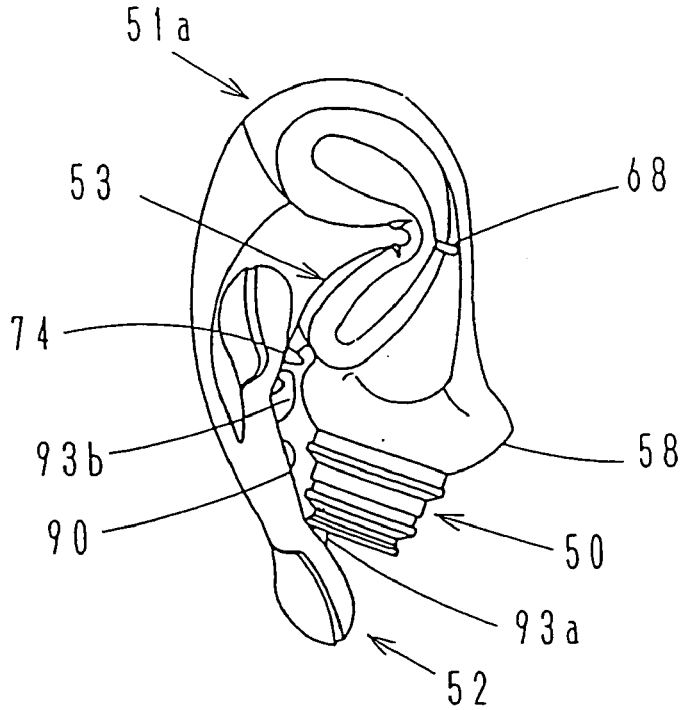

In a manner as described above, the hook 92 of the hanging piece 93*b* of the bottom wall 90 is engaged with the hook 74 of the handle 53. Alternatively, the hook 92 of the hanging piece 93*a* is engaged with an inner surface of the neck 50, so as to keep the neck 50 and the bottom 52 in an engaging manner, so that the bottle for disposal can be largely deformed as shown in FIGS. 25 (*a*), (*b*).

Since plastic deformation occurs, the flat body 51*a* cannot be recovered to its original shape without adding the external force. However, it may be considered that the flat body 51*a* is insufficiently deformed to occur the plastic deformation. In such a case, the engagement of the neck 50 with the bottom 52 prevents the folded flat body 51*a* from recovering its original shape.

Resultantly the folded bottle for disposal having a considerably little volume can be achieved.

The effect of providing two hanging pieces 93*a*, 93*b* on the bottom wall will be described herewith. In case of engaging the hanging piece 93*a* with the inner surface of the neck 50, the bottle cannot be put the cap, while the position of the hanging piece 93*a* and the neck 50 is easily confirmed to engage therewith.

In case of engaging the hanging piece 93*b* with the hook piece 73 of the handle 53, it is possible to waste the bottle with the cap.

For a requirement of wasting the bottle separately from the cap by a reason of different material resin between the bottle and the cap, the use of hanging piece 93*a* or 93*b* can be selected if desired.

The Third Embodiment

The third embodiment in accordance with FIGS. 26 to 36 will be described herein. In this embodiment, the shape of the lower body and the arrangement of bending ribs are respectively altered.

Figure 26:
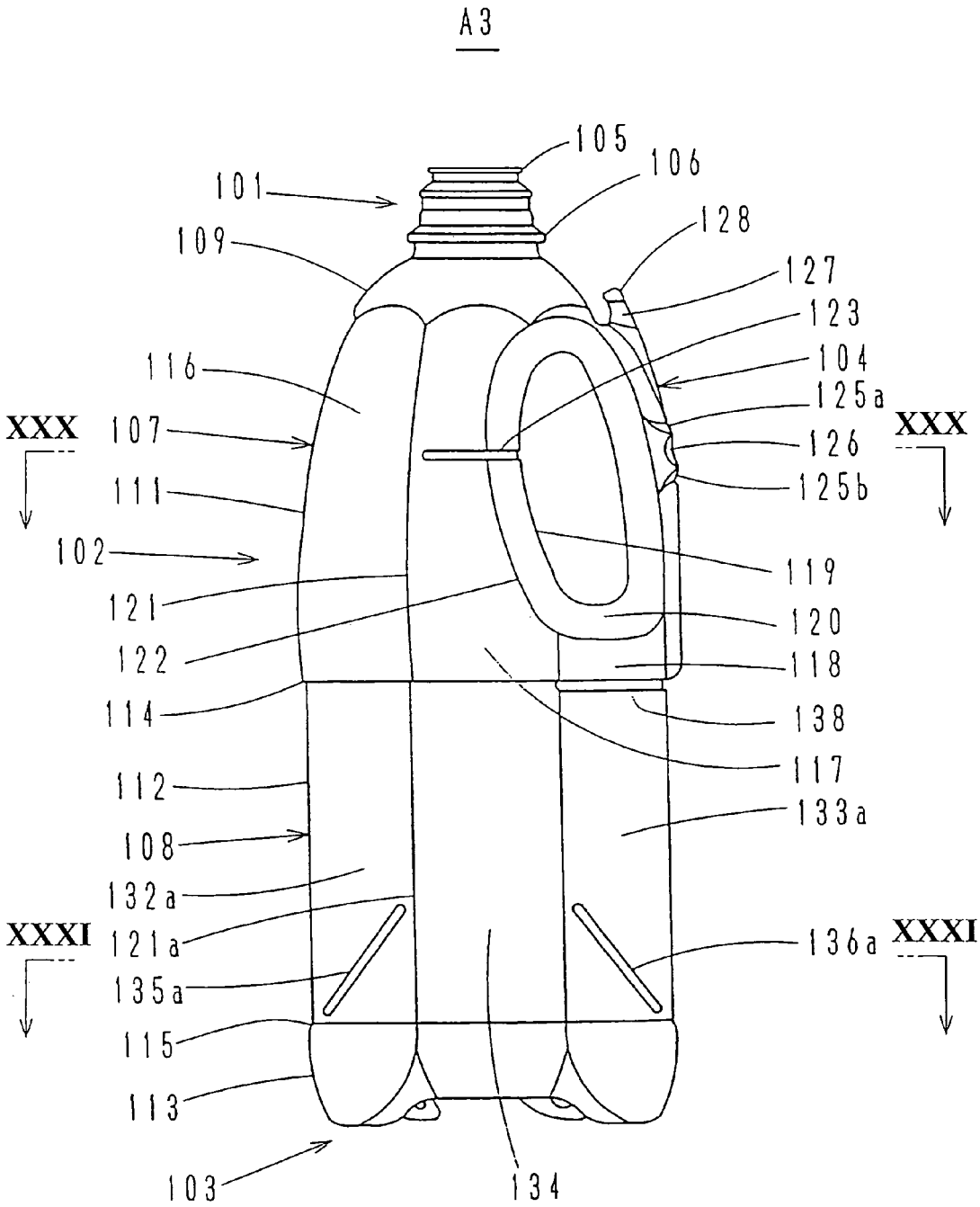
FIG. 26 is a front view in accordance with the third embodiment of the invention.
Figure 27:
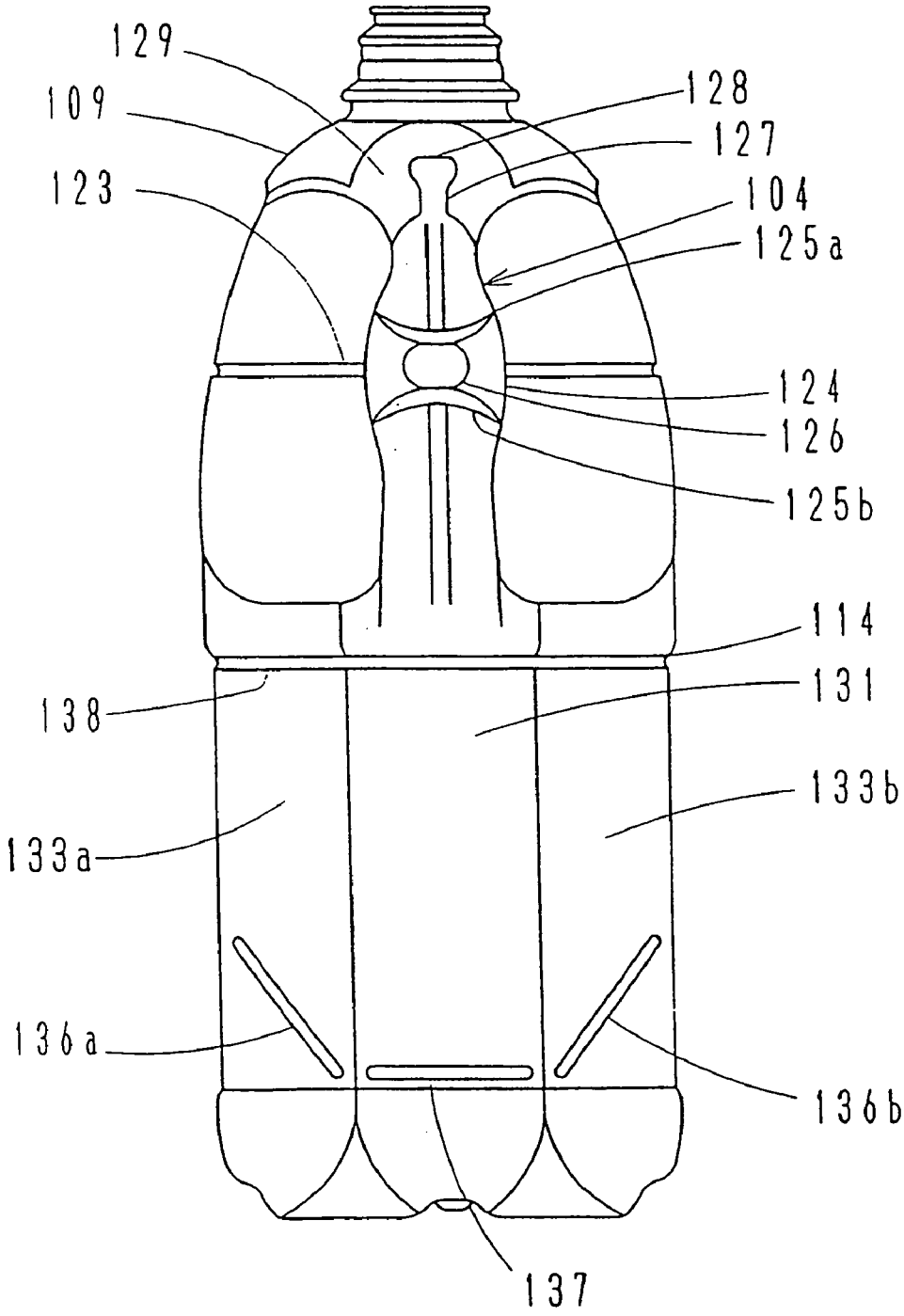
FIG. 27 is a right side view of the bottle shown in FIG. 26.

As shown in FIGS. 26 and 27, a bottle A3 comprises a neck 101, a body 102 and a bottom 103, and the body 102 includes a handle 104.

The bottle A3 is formed by a blow molding of synthetic resins such as polyolefins and the like. The bottle A3 may be formed from a single layer of synthetic resin or from a multi-layered one.

A bulged collar or ring 105 and a protruded lip 106 are provided on an external circumference of the neck 101.

The body comprises an upper body 107 including the handle 104 and a lower body 108 having a rectangular cross sectional shape. Each of the upper body 107 and the lower body 108 has an equilateral octagonal cross section and includes eight surfaces.

The upper body 107 comprises a semi-spherical shoulder wall 109 connected to the neck 101 and a circumferential wall 111. The lower body 108 comprises a lower body wall 112 having an octagonal cross sectional shape and a bottom circumferential wall 113 adjacent to the wall 112.

The body wall 112 has less diameter than the wall 111, and is adjacent to the circumferential wall 111 via a stepped wall 114. A stepped wall 115 is also provided between the body wall 112 and the bottom circumferential wall 113.

Figure 28:
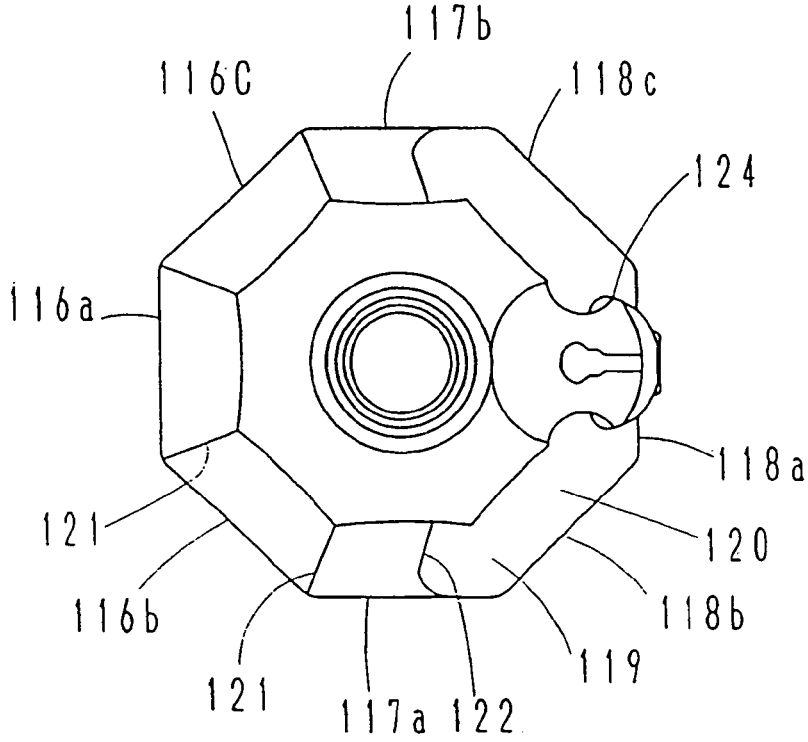
FIG. 28 is a plane view of the bottle shown in FIG. 26.
Figure 30:
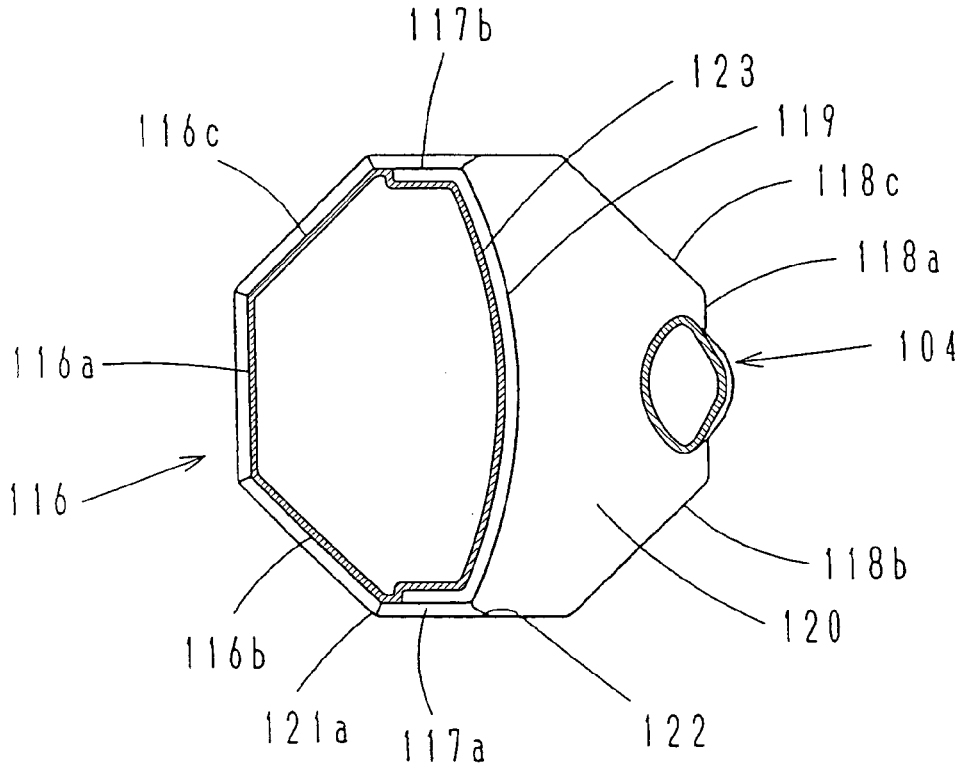
FIG. 30 is a cross sectional view of the bottle along line A-A of FIG. 26.

As shown in FIGS. 26, 28 and 30, the circumferential wall 111 includes three walls 116 arranged in a left side, a front wall 117, a rear wall 117, three walls 118 arranged in a right side, an inwardly curved wall 119 adjacent to the front and the rear walls 117, and a wall 120 adjacent to an upper edge of the wall 118 and a lower portion of the curved wall 119.

The wall 116 arranged in the left side comprises a left side wall 116*a*, a front-left side wall 116*b* adjacent to the left side wall 116*a*, and a rear-left side wall 116*c* adjacent to the left side wall 116*a*. The wall 118 arranged in the right side comprises a right side wall 118*a*, a front-right side wall 118*b* adjacent to the right side wall 118*a*, and a rear-right right side wall 118*c* adjacent to the right side wall 118*a*.

Each of the walls 116*a*, 116*b*, 116*c*, 117*a* and 117*b* is formed of a outwardly curved surface including a ridge line 121 which connects with a lower edge of the shoulder wall 109 and the stepped wall 114. Each of walls 118*a*, 118*b* and 118*c* is formed of a plan surface.

Each of right side edges of the front wall 117 and the rear wall 117 is formed to be an arcuate ridge line 122. The inwardly curved wall 119 is formed of a curved surface adjacent to the arcuate ridge line 122. A lateral rib 123 is formed in the inwardly curved wall 119 at a middle in an axial direction, and extends to the front wall 117*a* and the rear wall 117*b*.

As shown in FIGS. 26 and 27, the handle 104 extends from an upper end of the shoulder wall 109 and the curved wall 119 to the wall 120, and faces to the inwardly curved wall 119. In the illustrated embodiment, the handle 104 is integrally formed with the upper body 107. As shown in FIG. 30, the handle 104 has a cross sectional shape having an arcuate inside.

The handle 104 is provided with a middle bulged portion 124 at a middle portion in the longitudinal direction. The middle bulged portion 124 is provided in an outer surface with stepped walls 125*a*, 125*b* spaced apart from each other. Between the stepped walls, the outer surface of the handle is protruded.

In the protruded surface between the stepped walls 125*a*, 125*b*, a concave portion 126 is formed.

The handle 104 is provided with an engaging piece 127 upwardly protruded. The engaging piece 127 has a hook 128 inwardly protruded in its upper end.

The shoulder wall 109 is partially formed with a flat portion 129 facing the engaging piece 127.

Figure 31:
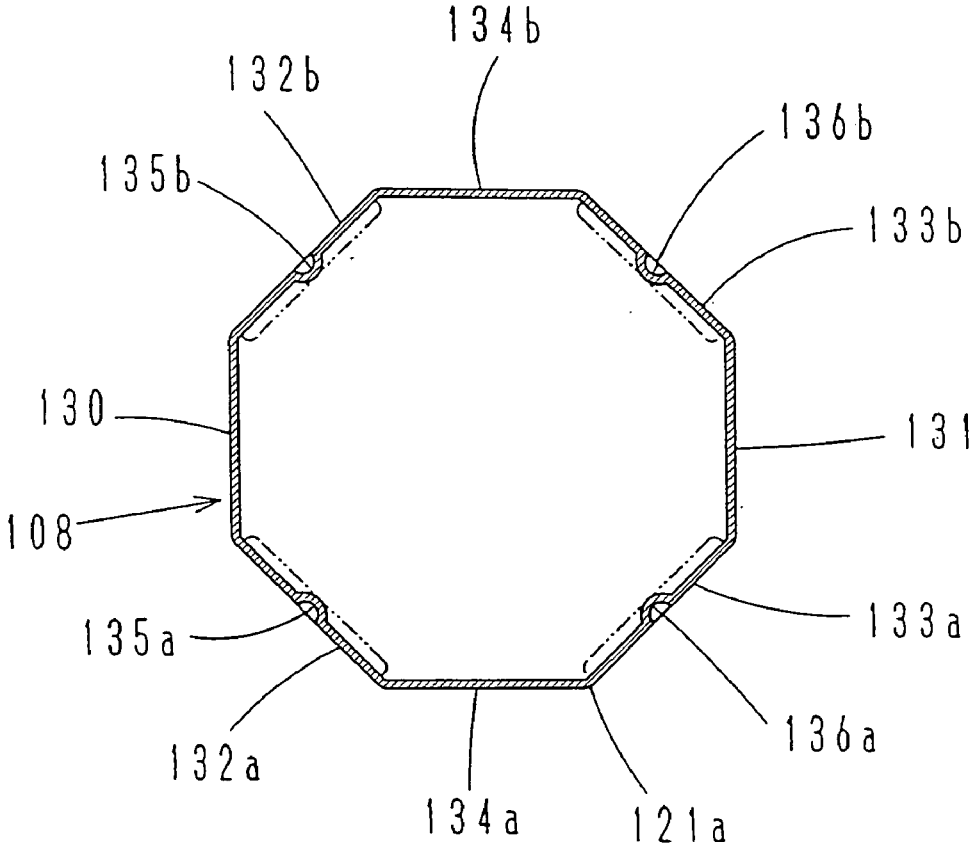
FIG. 31 is a cross sectional view of the bottle along line B-B of FIG. 26.

As shown in FIGS. 26, 27 and 31, the body wall 112 of the lower body 108 comprises a left side wall 130, a right side wall 131, a front-left side wall 132*a*, a rear-left side wall 132*b*, a front-right side wall 133*a*, a rear-right side wall 133*b*, a front wall 134*a* and a rear wall 134*b*. Each of the walls is adjacent with each other through the ridge line 121.

Slanted ribs 135*a*, 135*b* are formed on the left side slanted walls 132*a*, 132*b*. Respective ribs 135*a*, 135*b* extend from the left side lower end of slanted walls 132*a*, 132*b* toward the vicinity of the ridge line 121*a*.

In the walls 132*a* and 132*b* positioned at right side, ribs 136*a*, 136*b* are formed on the right side slanted walls 133*a*, 133*b* symmetrically with slanted ribs 135*a*, 135*b*. A lateral rib 137 is formed on an lower end portion of the right side wall 131.

A lateral rib 138 is provided extending on respective upper ends of the walls 133*a*, 133*b* and 131. Each of the front-right side wall 133*a*, the rear-right side wall 133*b* and the right side wall 131 is adjacent to the stepped wall 114 via the lateral rib 138.

Each of the ribs 123, 137, 138, 135 and 136 acts as a bending rib having an arcuate cross section, as well as the first and second embodiments.

Figure 29:
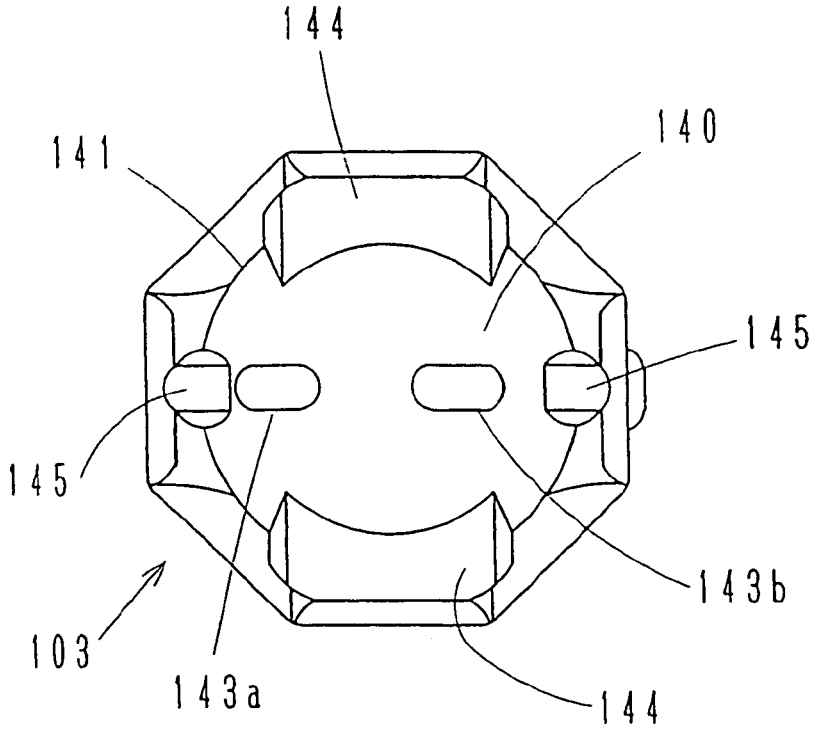
FIG. 29 is a bottom view of the bottle shown in FIG. 26.
Figure 32:
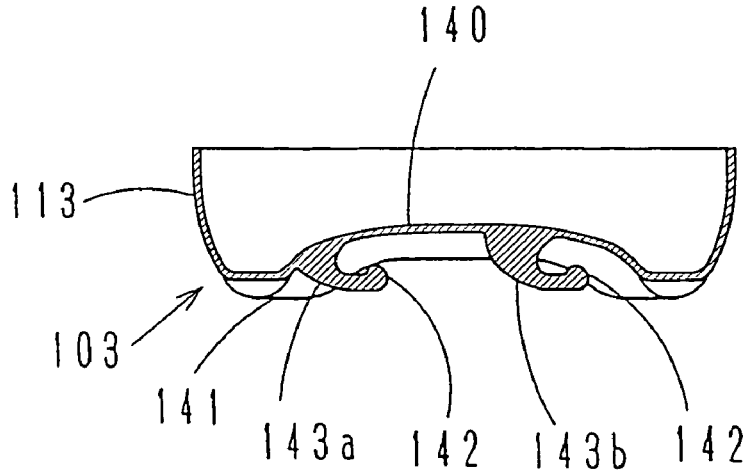
FIG. 32 is a longitudinal sectional view of the bottle bottom.

As shown in FIGS. 29 and 32, the bottom 103 comprises a bottom wall 140 and a bottom end wall 141 which is provided at a periphery of the bottom wall 140 and connects to the bottom circumferential wall 113 of the body 102. Two hanging pieces 143*a*, 143*b* are formed on the bottom wall 140 along the parting line. A hook 142 is formed in respective ends of hanging pieces 143*a*, 143*b*, and protrudes inwardly.

The bottom end wall 141 is formed with recessed portions 144 at front and rear opposite positions with respect to the parting line, and notches 145 oppositely provided on the parting line.

A method of squeezing the bottle according to this embodiment will be describe hereinbelow.

The way of squeezing is summarized herewith. The body walls of the lower body 108 and the upper body 107 are reversed to decrease the volume, the body 102 is pressed to flatten, and then the handle 104 is bent to obtain the flattened bottle for disposal.

Further, if necessary, the flattened body 102*a* is curved by bending the upper body 107 to obtain the further squeezed bottle.

Next, the function or effect of squeezing the bottle will be described with reference to accompanied drawings.

Figure 33:
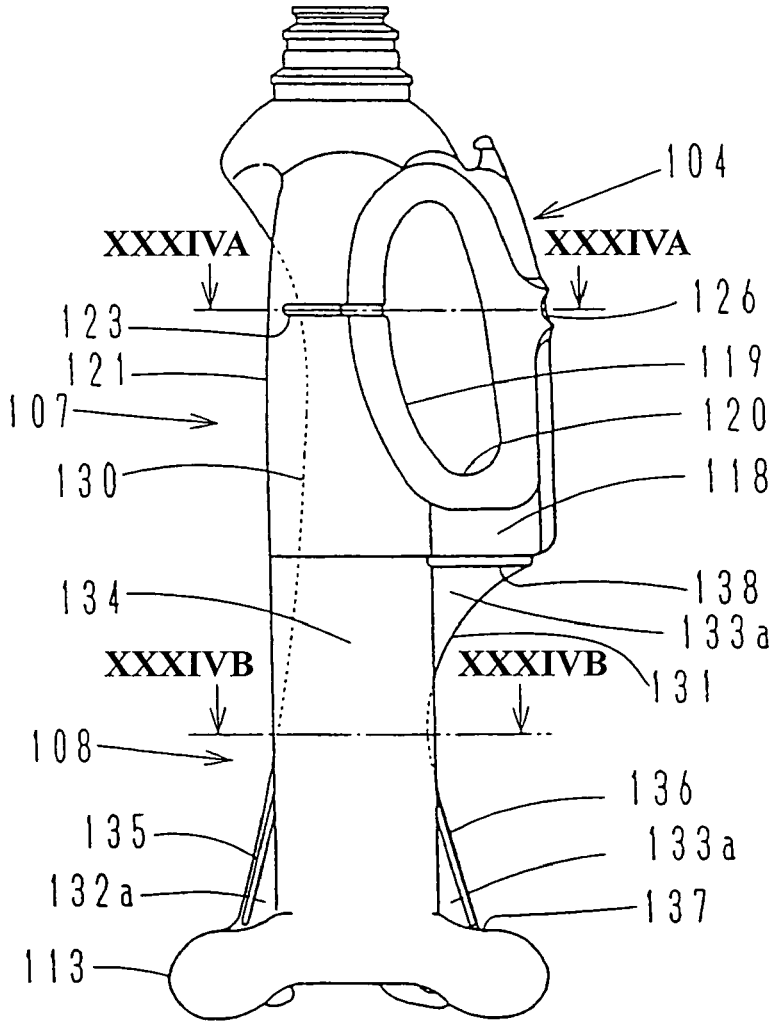
FIG. 33 is a front view of the reversely deformed bottle.
Figure 34A:
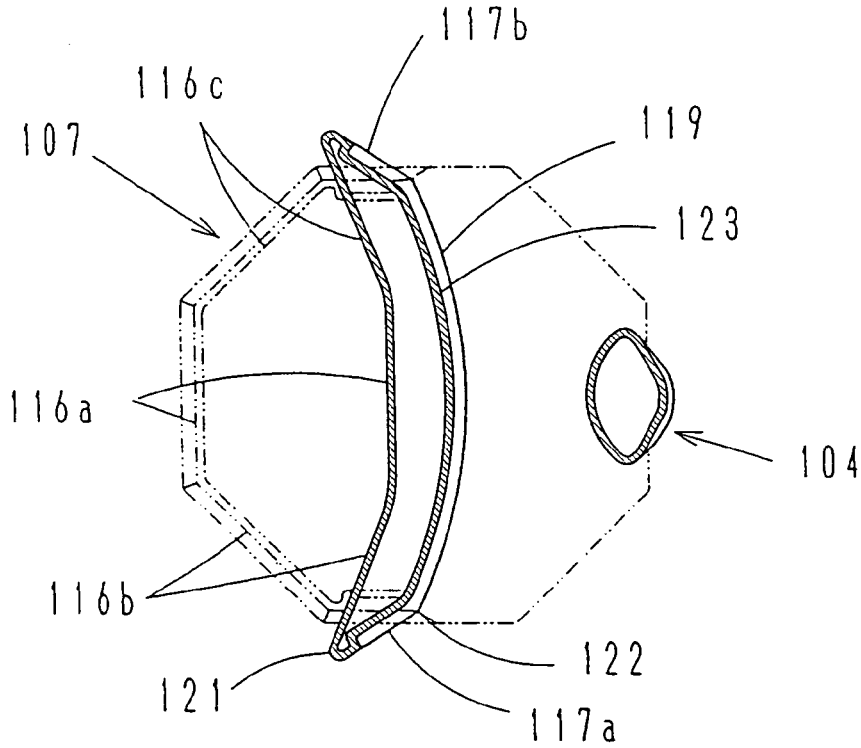
FIG. 34 is a cross section view of the bottle, in which (a) is a cross sectional view thereof along line A-A of FIG. 33 and (b) is a cross sectional view along line B-B of FIG. 33.
Figure 34B:
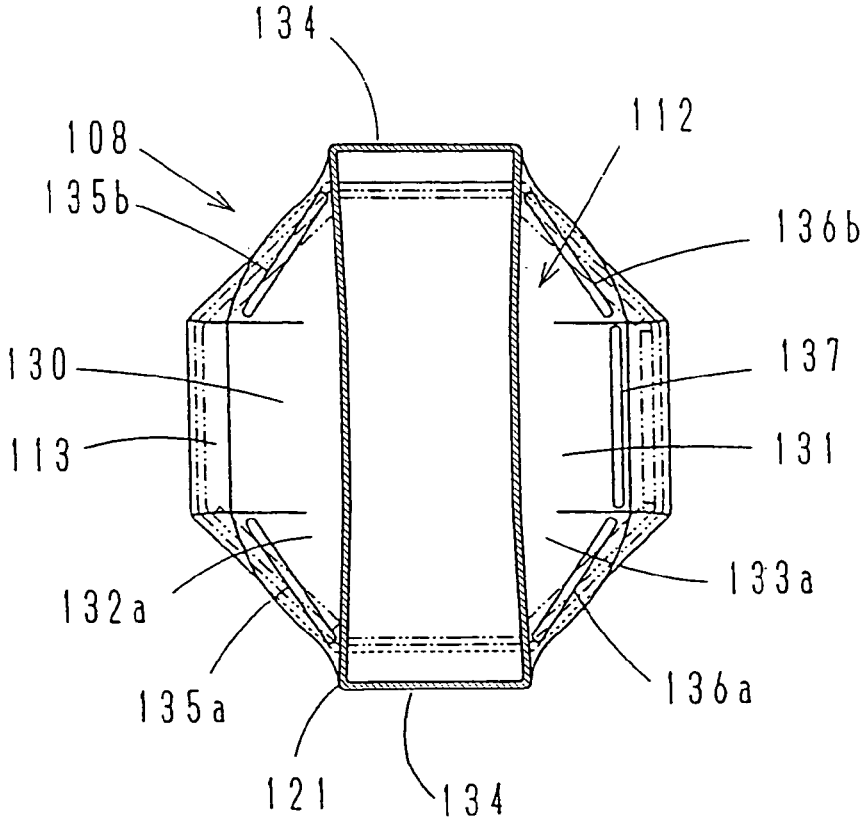

First, the lower body 108 of the bottle A3 is pressed inwardly. As shown in FIGS. 33 and 34 (*b*), the wall 130, 132*a* and 132*b* are reversely deformed around the ridge line 121 and the inclined rib 135.

In accordance with the reverse of the side wall 130, the bottom circumferential wall 113 is also deformed.

The right side of the lower body 108 is reversely deformed around the axis of the ridge line 121 between the walls 133 and 134. The wall 131 is reversed around the lateral rib 138 and 137 formed in upper and lower ends. Corresponding to the reverse of the side wall 131, the walls 133*a* and 133*b* are bent around the folding line of the ridge line 121 and the ribs 136*a*, 136*b*, and are deformed to a curved manner.

Next, when the circumferential wall 111 of the upper body 107 is pressed inwardly from both sides, the left half side walls 116*a*, 116*b*, 116*c* are reversely deformed around the axis of the ridge line 121, as shown in FIG. 34 (*a*).

Since the lateral rib 123 is formed, the front and rear walls 117 are folded around the arcuate ridge line 122, the ridge line 121 is protruded forwardly and rearwardly. Since the wall 116 has been reversed, the ridge line 121 is kept its protruded manner.

The reverse of the upper body 107 maintains the reverse of the lower body 108, so as to certainly prevent the lower body 108 from recovering.

Resultantly, a reversed bottle which volume is decreased is obtained as shown in FIGS. 33 and 34.

Next, when the lower body 108 as illustrated in FIG. 33 is pressed inwardly from left and right sides, the body wall 112 of the portion 108 protrudes its middle portion forwardly and rearwardly, so as to be flattened.

Then, the circumferential wall 111 of the upper body 107 is pressed from left and right sides. Since the lateral rib 123 is formed from the inwardly curved wall 119, the front wall 117*a* and the rear wall 117*b* are difficult of bending. Thus, the ridge line 121 between the walls 116*b* and 117*a* and the ridge line 121 between the walls 116*c* and 117*b* are protruded forwardly and rearwardly.

Figure 35:
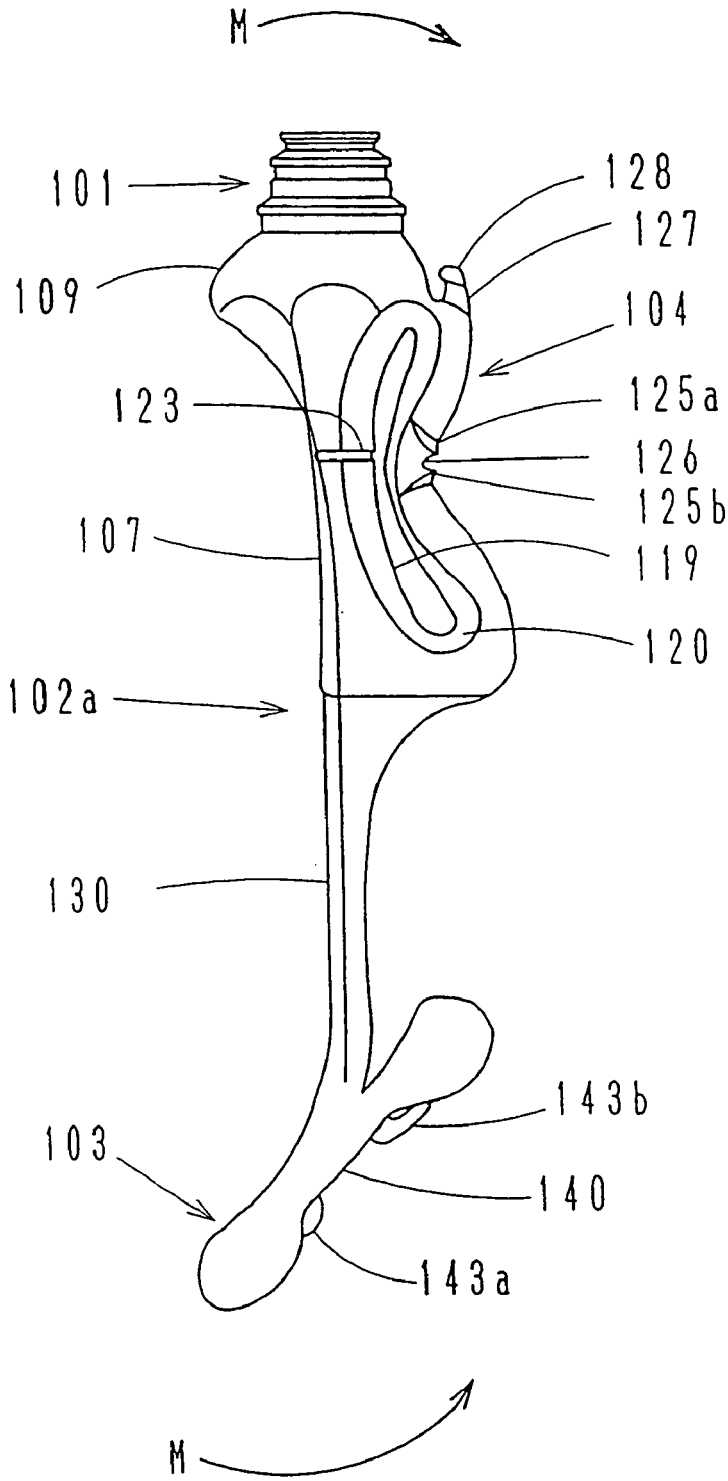
FIG. 35 is a front view of the flattened bottle.

Then, when the neck 101 or the upper body 107 is grasped and the bending force is applied to the handle 104, the handle 104 is bent around the concave portion 126 of the middle bulged portion 124 or the stepped wall 125*b*, as shown in FIG. 35.

Because of the wall 120, the walls 118*a*, 118*b* and 118*c* of the upper body 107 are difficult to be deformed. Thus, the walls 118*a*, 118*b* and 118*c* are deformed to be slightly flat, corresponding to the left side deformation of the body 102.

The thus obtained body 102 is deformed into the flat body 102*a* in which the volume of the upper body is decreased and the lower body is flattened.

At this time, the neck 101, the shoulder wall 109 and the bottom wall 140 are kept their original shape without deformation.

Next, the bending force is applied to the bottom 103, the bottom 103 is folded in respect of the flat body 102*a*, so as to be deformed as shown in FIG. 35, thereby the flattened bottle for disposal can be obtained.

Then, when the bending force M is applied on the neck 101 and the bottom 103 as illustrated in FIG. 35, the front wall 117*a*, the rear wall 117*b* and the inwardly curved wall 119 are folded around the lateral rib 123, so that the circumferential wall 111 of the upper body 107 is curved or deformed.

The bending force M is further applied, the flat body 102*a* is bent such that the neck 101 contacts with the bottom wall 140.

Figure 36:
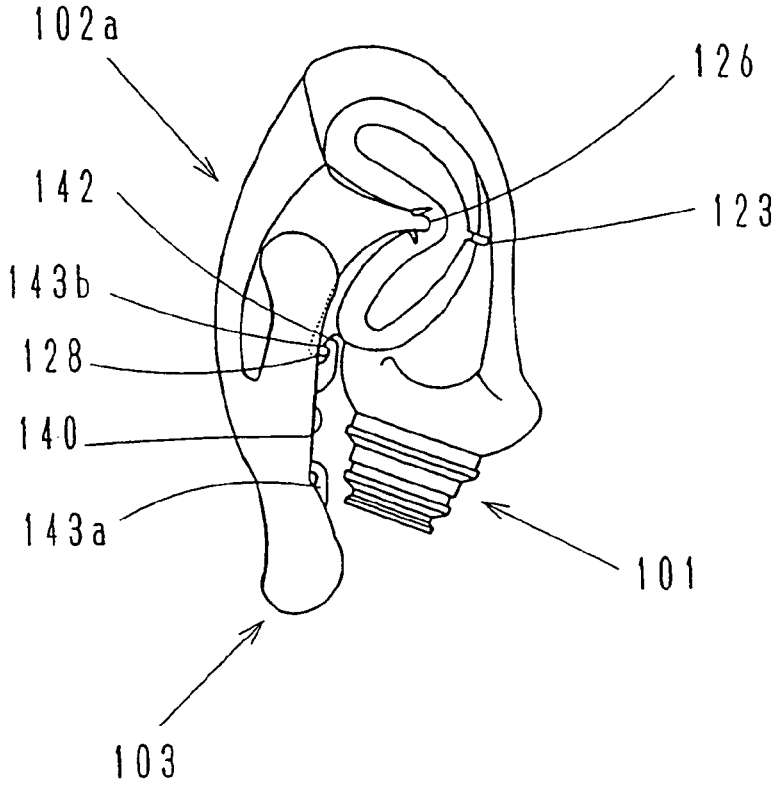
FIG. 36 is a front view of the bent waste bottle.

In this state, when the hook 142 of the hanging piece 143*b* mounted on the bottom wall 140 is engaged with the hook 128 of the engaging piece 127 of the handle 104, or when the hook 142 of the hanging piece 143*a* is engaged with inner surface of the neck 101, the neck 101 and the bottom 103 are kept their engagement, and the bottle is further deformed as shown in FIG. 36.

As well as the second embodiment, plastic deformation occurs in the flat body 102*a*, and the flat body may not be recovered except of adding the external force, like the second embodiment. However the curved deformation of the flat body 102*a* is not sufficient to the plastic deformation. Thus, the curved and folded flat body 102*a* is prevented from recovering by engaging the neck 101 with the bottom 103.

As described hereinbefore, the folded bottle which volume is considerably decreased can be obtained.

Now each modified examples common with respective embodiments will be described.

In respective embodiments, the handle is integrally formed with the body of the bottle at the time of a blow molding. However, the conventional handle which is separately molded may be integrated with the body by an insert molding at a blow molding.

FIGS. 50 to 53 show a bottle with a handle separately formed as a member independent from the bottle. A handle comprises a grip plate 411 and a securing beam plate 412 and on a middle portion of the axial direction of the handle, bending portions 416, 417 are formed on the plate 411, 412 respectively. In the illustrated example, respective bending portions 416, 417 are thin, however the shape of bending portions may not be limited to the illustrated example. In the illustrated example, the bending portion 416 is formed on an inner surface of the board 411 to keep an appearance of the handle and the bottle, the invention may not be limited to the example as illustrated. Further the shape of the handle may not be limited to the example as illustrated either. Although in FIGS. 50 and 51, ribs effecting as a bending rib is not shown on the bottle body, ribs disclosed by embodiment described hereinbefore can be formed.

The bending portion such as a concave groove is mounted on a middle surface of the handle and the upper body can be easily curved by squeezing the handle at the time of wasting or by removing it from the body to achieve effects as described hereinbefore. In case of eliminating the bending portion from the handle, the handle may effect on the bottle as an reinforce vertical beam and may deteriorate squeezing effect to decrease the volume of the bottle for wasting it, however conventional problem will be solved by the invention to form the bending portion on the handle.

Each embodiment has a structure for providing a bottle to be folded, however a part of these constructions may be eliminated for wasting a flattened bottle for disposal.

That is, in the first embodiment, for wasting the flattened bottle, the bottom needs not to be engaged with the neck, and the engaging piece on the bottom wall can be eliminated.

Further in the second and the third embodiments, the engaging piece of the bottom wall and the engaging piece of the handle can be also eliminated from the structure of the invention.

For the case of the flattened bottle, the upper body needs not to be deformed to be curved by applying the bending force on the neck and the bottom, and in each embodiment, an extension of lateral ribs between the curved surface and the side wall adjacent therewith will not be required.

Although in the bottle in the embodiments, the neck is provided with the bulged ring and the holding lip for engaging the cap or the inner stopper, the cover body of the bottle is not limited specifically, and a cover with a packing, a cap engaged with a stopper or a combination of a stopper and a cap may be applicable.

Further a screw type cap which the neck circumference is threaded may be used.

In each embodiment, the specific shape of the body or the bottom is described, while the flat bottle of which vertical body has a circular cross section, a rectangular cross section or an oval cross section may be used for squeezable bottle by means of bending ribs formed in predetermined portions.

EXAMPLES

Modified examples in respect of the squeezable deformed portion of the handle, the engaging member for the neck and the bottom of the folded bottle will be described.

In the first embodiment, the squeezable deformed portion of the handle comprises stepped walls provided on the surface of the middle bulged portion of the longitudinal middle portion (that is, the bending portion), and the downward rib provided along the connecting part of the body and the curved wall (that is, bending ribs). In the second and the third embodiments, said portion comprises bending portions comprising stepped walls and concave portions vertically formed on the surface of the middle bulged portion of the handle. However, other various modified examples may be applicable.

In respect of the engaging member of the neck and the bottom of the bottle, in the second and the third embodiments, for obtaining the folded bottle by providing the engaging piece on the upper end portion and providing the hanging piece on the bottom of the handle, the bottle neck and the bottom thereof is kept their engagement by engaging the engaging piece with the hanging piece, while for the engagement of the neck and the bottom, various modified examples for engaging the neck and for hanging the bottom may be applicable.

First modified examples of the bending portion provided on the longitudinal middle portion of the handle will be described.

First Example

Figure 37A:
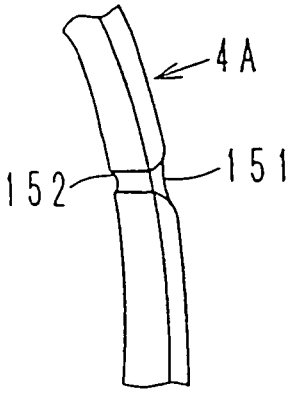
FIG. 37 shows the first example of the bent and deformed portion of the handle, in which (a) and (b) are a side view and a front view of the handle respectively.
Figure 37B:
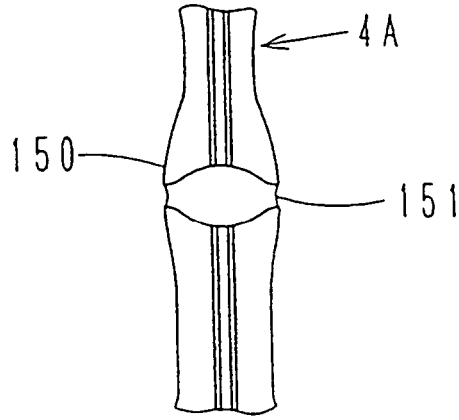

As shown in FIG. 37, an oval concave portion 151 is provided on an outer side of a middle bulged portion 150 of a handle 4A, and a concave rib 152 is provided on a rear side of the handle 4A.

The bending portion of the handle arranged through the handle 4A is achieved by the concave 151 and the concave rib 152.

As well as the first embodiment, the arcuate downward rib is arranged inside of the upper end of the handle 4A along the connecting part with the curved wall.

The squeezable deforming portion of the handle is formed by the bending portion and the downward rib.

Second Example

Figure 38A:
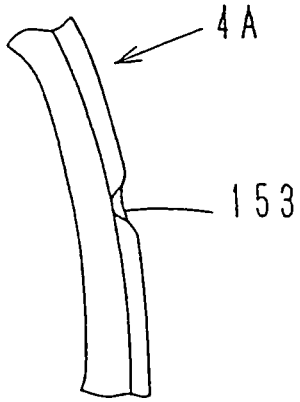
FIG. 38 shows the second example of the bent and deformed portion of the handle, in which (a) and (b) are a side view and a front view of the handle respectively.
Figure 38B:
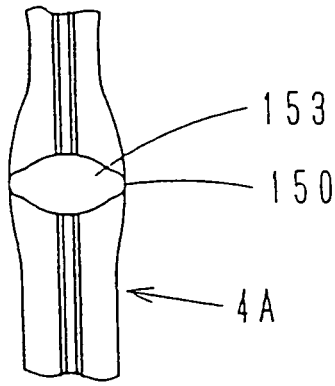

As shown in FIG. 38, an oval concave portion 153 is only provided for the bending portion on a surface of a middle bulged portion 150 of the handle 4A.

The concave rib is eliminated from the arcuate portion of the rear surface, while the space between upper and lower ends of the concave portion 153 becomes narrow to squeeze the handle and due to less spaces between out and rear of the outside arcuate portion, the handle is pressed from the outside pressure to be deformed easily.

Third Example

Figure 39A:
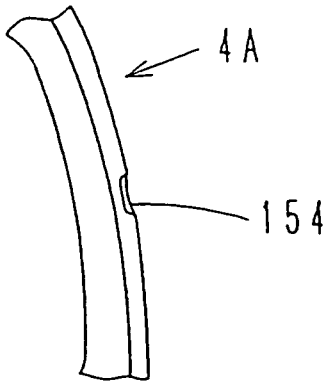
FIG. 39 shows the third example of the bent and deformed portion of the handle, in which (a) and (b) are a side view and a front view of the handle respectively.
Figure 39B:
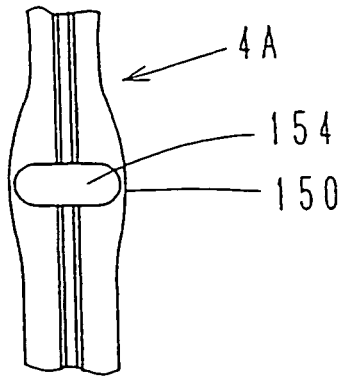

As shown in FIG. 39, a flat concave portion 154 which both ends designed to be arcuate is provided on the surface for the bending portion.

The space between upper and lower ends of the concave portion 154 becomes narrow to squeeze the handle, and the rear side arcuate portion is pressed as well as the second example to be deformed easily for bending the handle.

Fourth Example

Figure 40A:
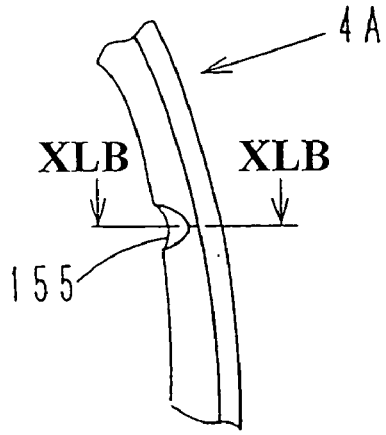
FIG. 40 shows the forth example of the bent and deformed portion of the handle, in which (a) is a side view of the handle and (b) is a cross sectional view along line A-A of (a)
Figure 40B:
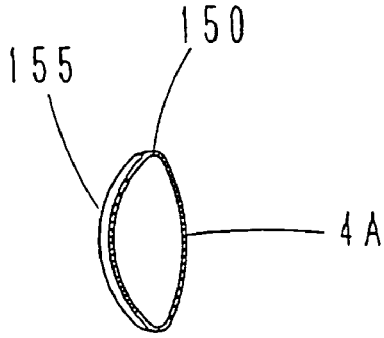

As shown in FIG. 40, an oval concave 155 is arranged on the rear surface of the middle bulged portion 150 for the bending portion.

The space between upper and lower ends of the concave portion 155 becomes wide to squeeze the handle. The outside arcuate portion has a large arcuate radius almost to be plane for easily bending, and more easily squeezing can be achieved than the handles of the second and the third examples.

The oval concave portion is also alternative to the concave rib 152 of the first example.

Further, a concave portion or a groove may be provided on the outside.

Figure 41A:
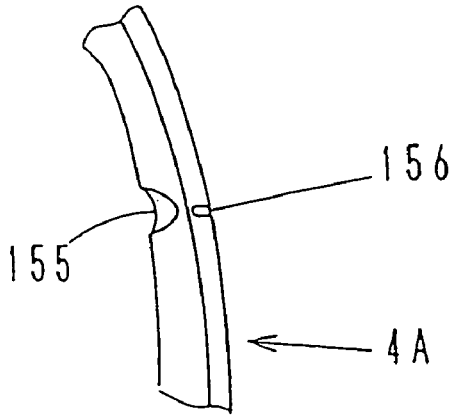
FIG. 41 is an explanatory view of the forth example of the bent and deformed portion of the handle, in which (a) and (b) are a side view and a front view of the handle respectively.
Figure 41B:
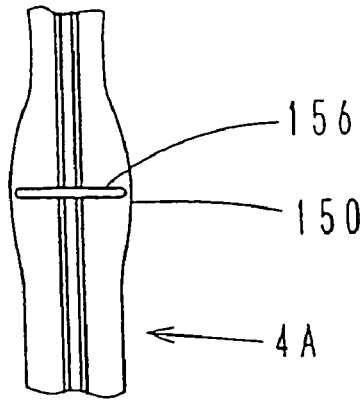

In FIG. 41, the rear side of the handle is provided with the concave portion 155, and the out side is provided with a groove 156.

For bending the handle, the out side is provided with a folder on the groove 156 to achieve more easily squeezable deformation.

Fifth Example

The bending portion may not be limited to be positioned at the middle portion exemplified as each example described hereinbefore.

Figure 42A:
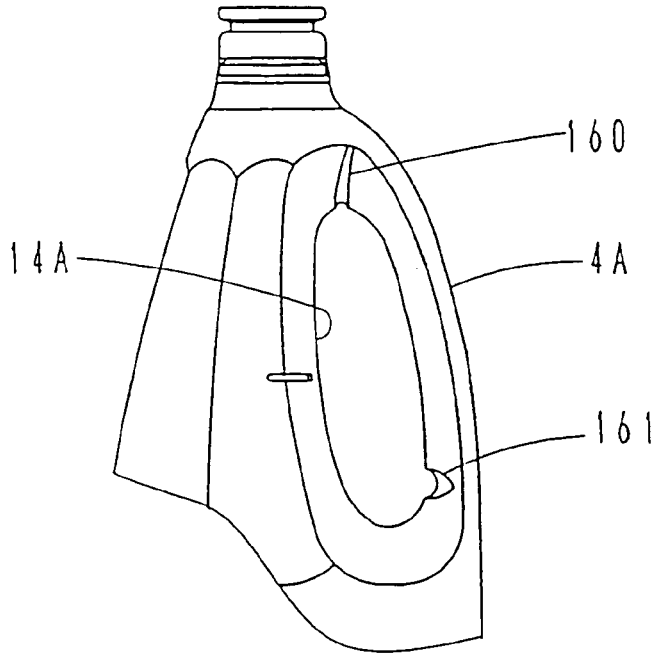
FIG. 42 shows the fifth example of the bent and deformed portion, in which (a) is a front view of the upper portion of the bottle, and (b) is a side view of the upper portion of the bottle and the handle.
Figure 42B:
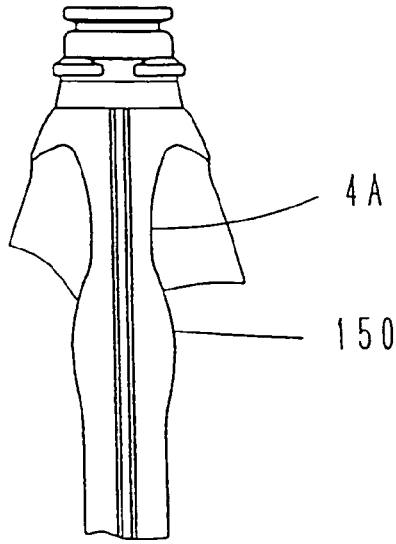

As shown in FIG. 42, an arcuate downward rib 160 is provided on the upper end inside of the handle 4A along the connecting portion with the curved wall 14A, and a concave portion 161 is provided for the bending portion at the lower end rear side of the handle 4A.

The squeezable deformed portion of the handle 4A comprises a downward rib 160 and a concave portion 161 to be a bending portion. When the middle portion of the handle 4A is pressed for bending, the downward rib 160 and the concave portion 161 are bent as well as the first embodiment, and the middle bulged portion 150 of the handle 4A can be easily curved.

In this example, the arcuate downward rib 160 is provided at the upper end inside of the handle 4A. The downward rib is alternative to be a concave portion as well as 161 on the upper end rear side, and the squeezable deformed portion may comprises two concave portions provided on upper and lower end portions.

Sixth Example

The modified example of the bending rib provided on the connecting portion with the body wall will be described.

Figure 43A:
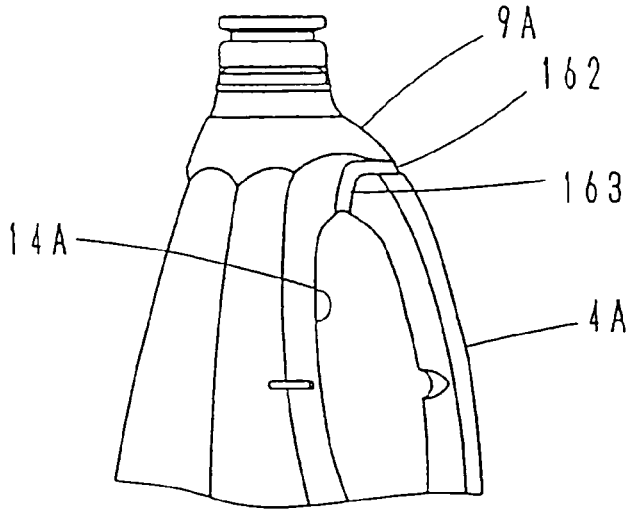
FIG. 43 shows the sixth example of bending rib of the bent and deformed portion, in which (a) and (b) are a front view and a side view of the upper portion of the bottle and the handle respectively.
Figure 43B:
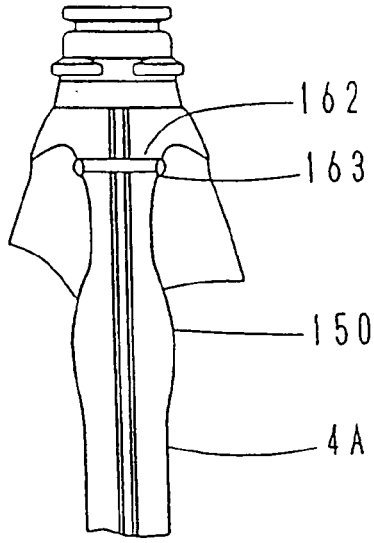

As shown in FIG. 43, on the upper end of the handle 4A, a lateral rib 162 is arranged on the connecting portion with a shoulder wall 9A, and an arcuate downward rib 163 is disposed on the connecting portion with a curved wall 14A.

The lateral rib 162 and the downward rib 163 are connected arcuately on the upper surface of the curved wall 14A to divide the handle 4A from the shoulder wall 9A and the curved wall 14A.

For folding the handle, the lateral rib 162 extends a cross wide direction to make the extension of the downward rib 163 narrow and the handle can be easily bent by the bending rib.

Seventh Example

The modified example of the engaging means of the neck and the bottom of the bottle will be described.

At first, an example of protruding the engaging piece from the neck or from the shoulder wall will be explained.

Figure 44A:
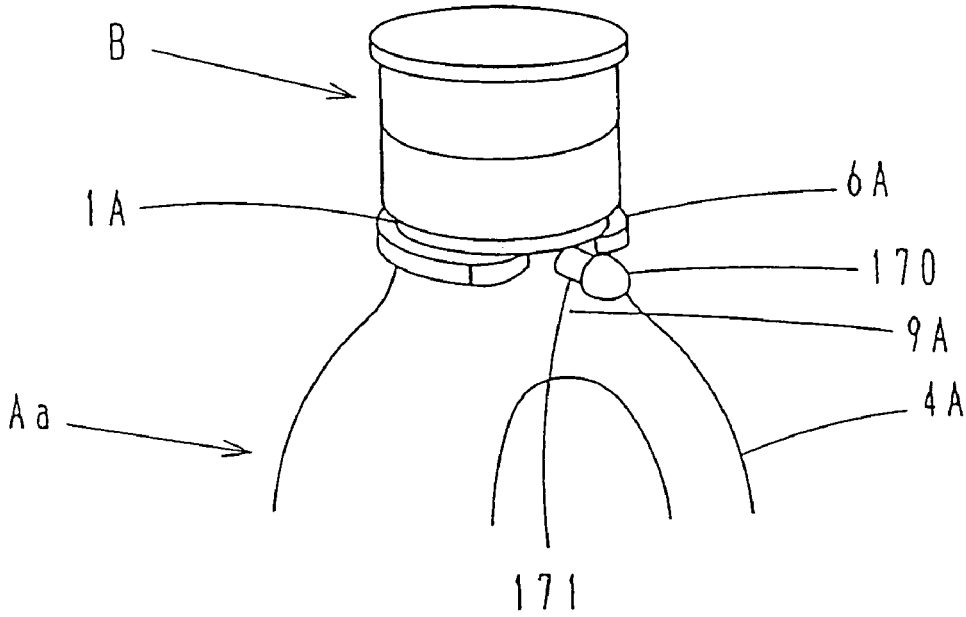
FIG. 44 shows the seventh example of an alternative example of the bottle neck and the engaging piece, in which (a) is a perspective view of the bottle neck, and (b) is a vertical cross sectional view of the bottle bottom.
Figure 44B:
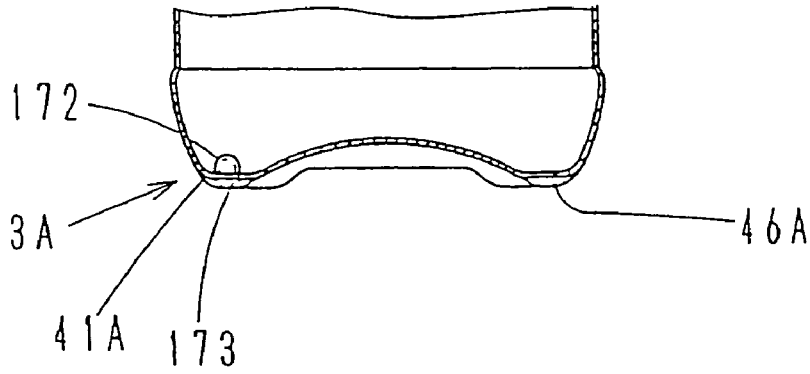

In FIG. 44, "Aa" indicates a bottle, "1A" is a neck of the bottle, "9A" is a shoulder wall, and B is a cap covered on the neck 1A.

A holding lip 6A is provided around the neck 1A, and an engaging piece 171 having a spherical head 170 is arranged between the lip 6A.

On a bottom end wall 41A of the bottom 3A, a concave portion 46A is formed at the opposite position to the parting line. On the bottom end wall 41A in vicinity of left side or right side, or both sides concave portion 46A, an engaging hole 173 is provided. A bottom of the hole 173 is formed in a spherical aperture 172 to engage with the engaging piece 171 on the neck 1A is projected.

For obtaining folded bottle by a way of squeezing described above, finally the engaging piece 171 is inserted through the engaging hole 173 of the bottom 3A, thereby the neck 1A and the bottom 3A are kept their engagement.

The engaging piece 171 may be projected upward of the handle from the shoulder wall 9A to obtain the same effect.

Further, the engaging hole 173 of the bottom 3A may be provided on the left or the right side surface of the bottom end wall 41A.

Eighth Example

The example of attaching an independent engaging member on the bottle neck will be described.

Figure 45A:
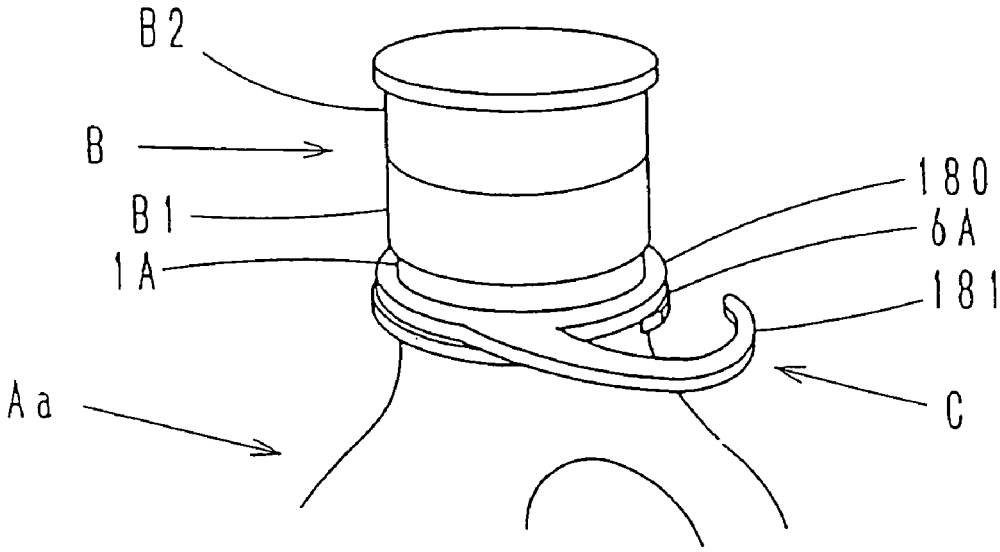
FIG. 45 shows the eighth embodiment of the bottom neck and the bottom, in which (a) is a perspective view of the bottle neck and (b) is an upper face view of the engaging member.
Figure 45B:
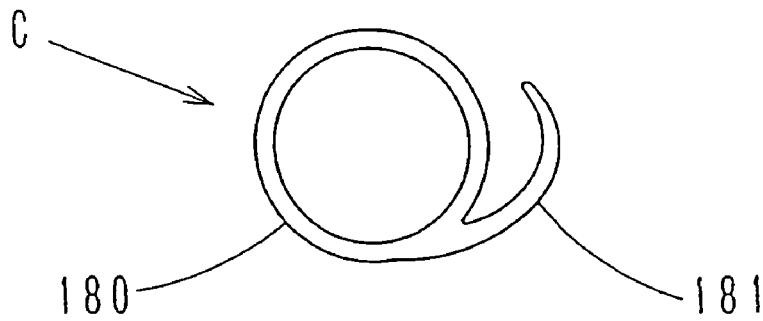

In FIG. 45 "Aa" is a bottle, "B" is a cap, and "C" is an engaging member. "A1" is a bottle neck. "6A" is a pair of holding lips protruding arcuately from the outer circumference of the neck 1A.

On the holding lips 6A, the engaging member C is loaded to be held between a cap body B1 and lips 6A by covering the cap B thereon.

The engaging member C comprises an annular plate 180 and an engaging hook 181 extending outwardly from the plate 180 for comprising the engaging portion.

For engaging the cap B by a stopper, at first the annular plate 180 is loaded on lips 6A of the neck and the cap B is covered thereon.

The inner diameter of the annular plate 180 is less than the outer circumference of the cap B and the thickness thereof may be sufficient to be kept on a determined position between the lower end of the cap B and the holding lip 6A.

Figure 46A:
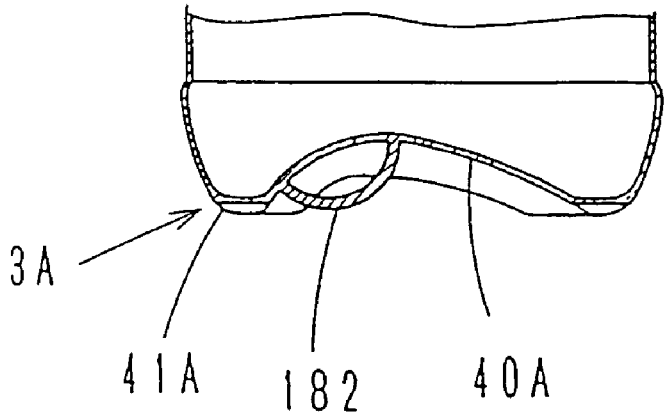
FIG. 46 is a cross sectional view of the hanging member, in which (a) shows the hanging ring and (b) shows the hanging bar.
Figure 46B:
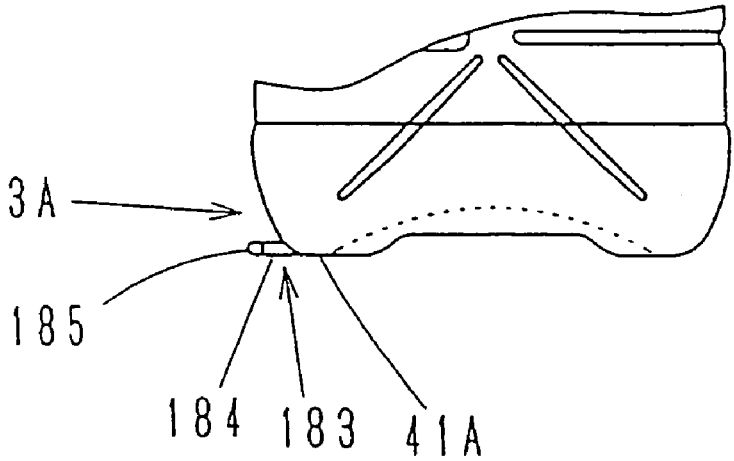

As shown in FIG. 46 (*a*), a semi-arcuate hanging ring 182 is vertically provided on the left side of the bottom wall 40A along the parting line to comprise a hanging member.

The end of the hanging ring 182 is positioned in vicinity of the bottom end wall 41A and the other end is positioned in vicinity of the central portion of the bottom wall 40*a* to downwardly project therefrom.

For obtaining the folded bottle, the hanging ring 182 of the hanging member of the bottom wall 40A is engaged with the engaging hook 181 of the engaging member C to keep the engagement of the neck 1A and the bottom 3A.

A hanging bar 183 is projected outwardly from the left end of the bottom end wall 41A of the bottom 3A as illustrated in FIG. 46 (*b*).

The hanging bar 183 comprises a support bar 184 extending from the longitudinal direction of the parting line toward the horizontal direction and an engaging bar 185 traversing from the end of the bar 184.

When the bar 184 of the hanging bar 183 is inserted through the engaging hook 181 of the engaging member C, due to a recover force of the flat body, the bar 184 is pressed to contact with the inner circumferential bending portion of the engaging hook 181, so as to connect the engaging bar 185 with the side surface of the engaging hook 181, thereby the neck 1A and the bottom 3A of the bottle are kept their engagement.

Ninth Example

Together with the engaging member, another example modified a structure of the hanging member of the bottle bottom will be described.

Figure 47A:
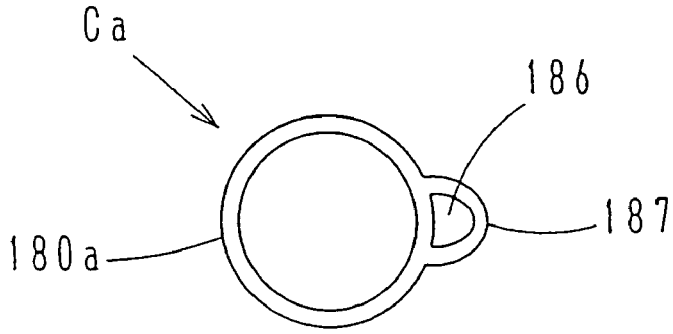
FIG. 47 shows the ninth example of the bottle neck and the bottom, in which (a) is an upper view of the engaging member, (b) shows a hanging pin of the hanging member, and (c) also shows a hanging piece.
Figure 47B:
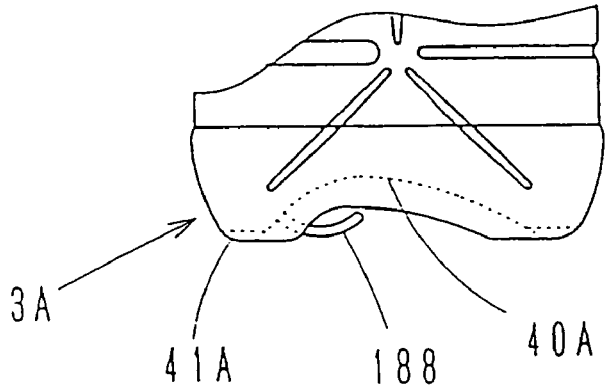
Figure 47C:
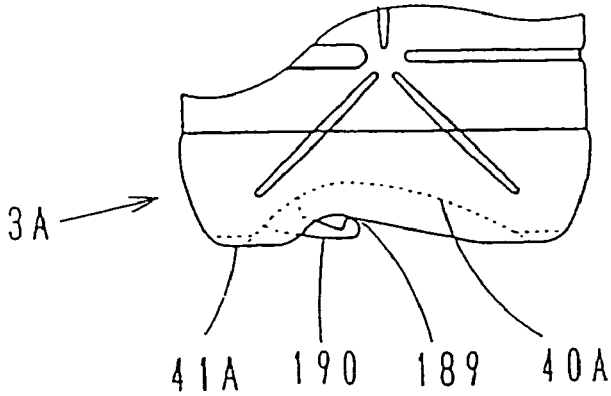

As shown in FIG. 47 (*a*), an engaging member Ca comprises an annular plate 180*a* and an arcuate engaging piece 187 which both ends connect with the outer circumference of the plate 180. The piece 187 is formed with an insert hole 186.

As shown in FIG. 47 (*b*), an arcuate hanging pin 188 which end has predetermined intervals from the bottom end wall 40A is provided on the bottom 3A.

For engaging the neck 1A and the bottom 3A, the engagement of the neck 1A and the bottom 3A is kept by inserting to engage a hanging pin 188 into the engaging piece 187.

The hanging member of the bottom 3A may be a hanging pin extending to the horizontal direction. Alternatively, the hanging member may be a hanging piece 190 provided its end with a hook 189 as shown FIG. 47 (*c*).

Tenth Example

Other example which modified a structure of the engaging member and the hanging member of the bottom will be described.

Figure 48A:
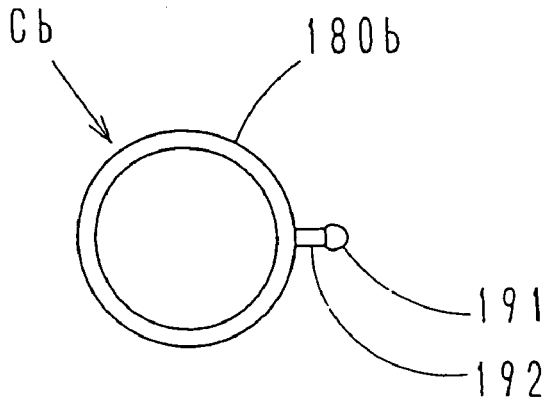
FIG. 48 shows the tenth example of the engaging means of the bottle neck and the bottom, in which (a) is an upper view of the engaging member, and (b) (c) shows a hole of the hanging member respectively.
Figure 48B:
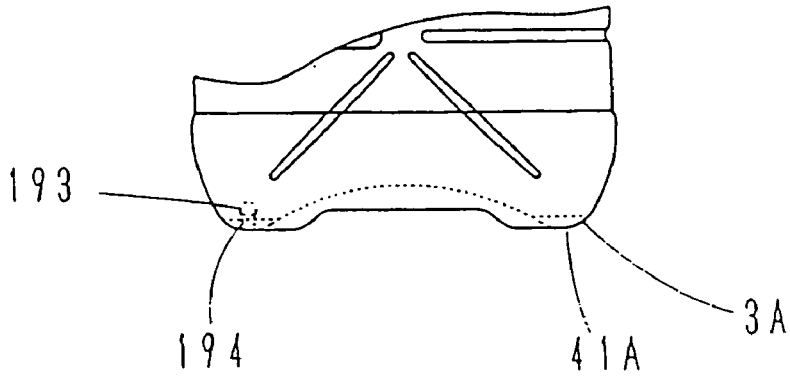
Figure 48C:
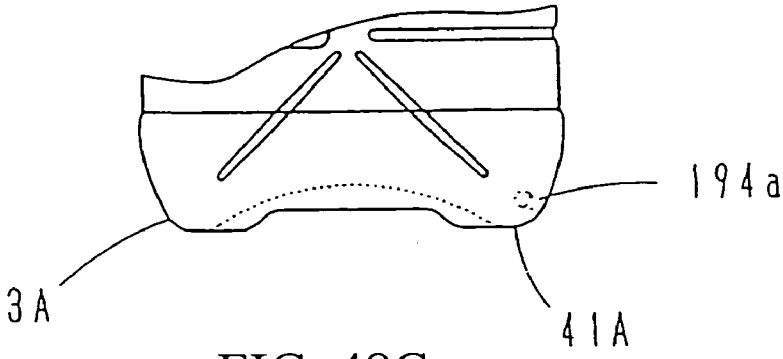

As shown in FIG. 48, an engaging member Cb comprises an annular plate 180*b* and an engaging piece 192 formed with a ball shape head 191 on the end projecting from the outer circumference of the plate 180*b*.

As shown in FIG. 48 (*b*), for an hanging member of the bottom 3A, an engaging and inserting hole 194 is provided at the under surface of the left or right side bottom end wall 41A of the bottom 3A to have a spherical aperture 193 for engaging the head 191.

As shown in FIG. 48 (*c*), an engaging and inserting hole 194*a* may be provided at the right side of the bottom end wall 41A.

The function or effect of an engagement of the bottle neck and the bottom as well as the effect of the engaging piece and the engaging hole of the seventh example can be obtained.

Eleventh Example

The modified example in which an engaging member is arranged on the cap of the bottle will be described.

The bottle molded from same resin of the cap can be wasted with the cap after squeezing it.

In that case, the engaging member is arranged on the bottle to engage with the hanging member of the bottle bottom so as to keep the engagement of the bottle neck and the bottom.

Figure 49A:
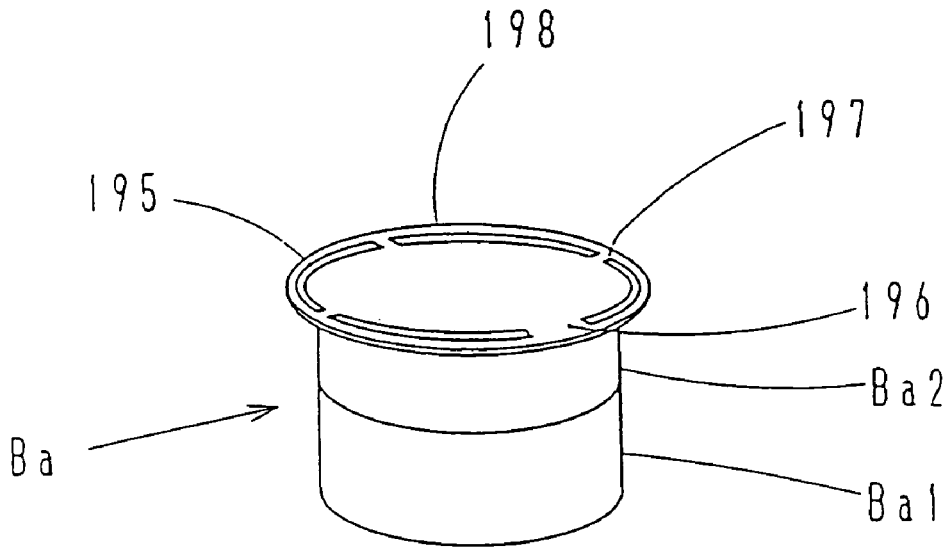
FIG. 49 shows the eleventh example of a cap attached with the engaging member, in which (a) is a perspective view of the cap, and (b) is a perspective view of the cap in state of turning the engaging member.
Figure 49B:
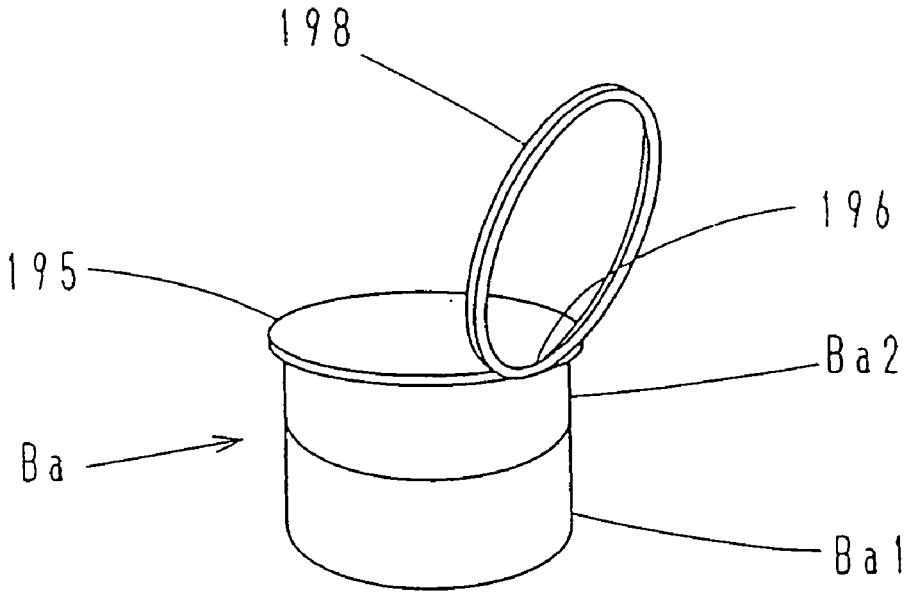
Figure 50:
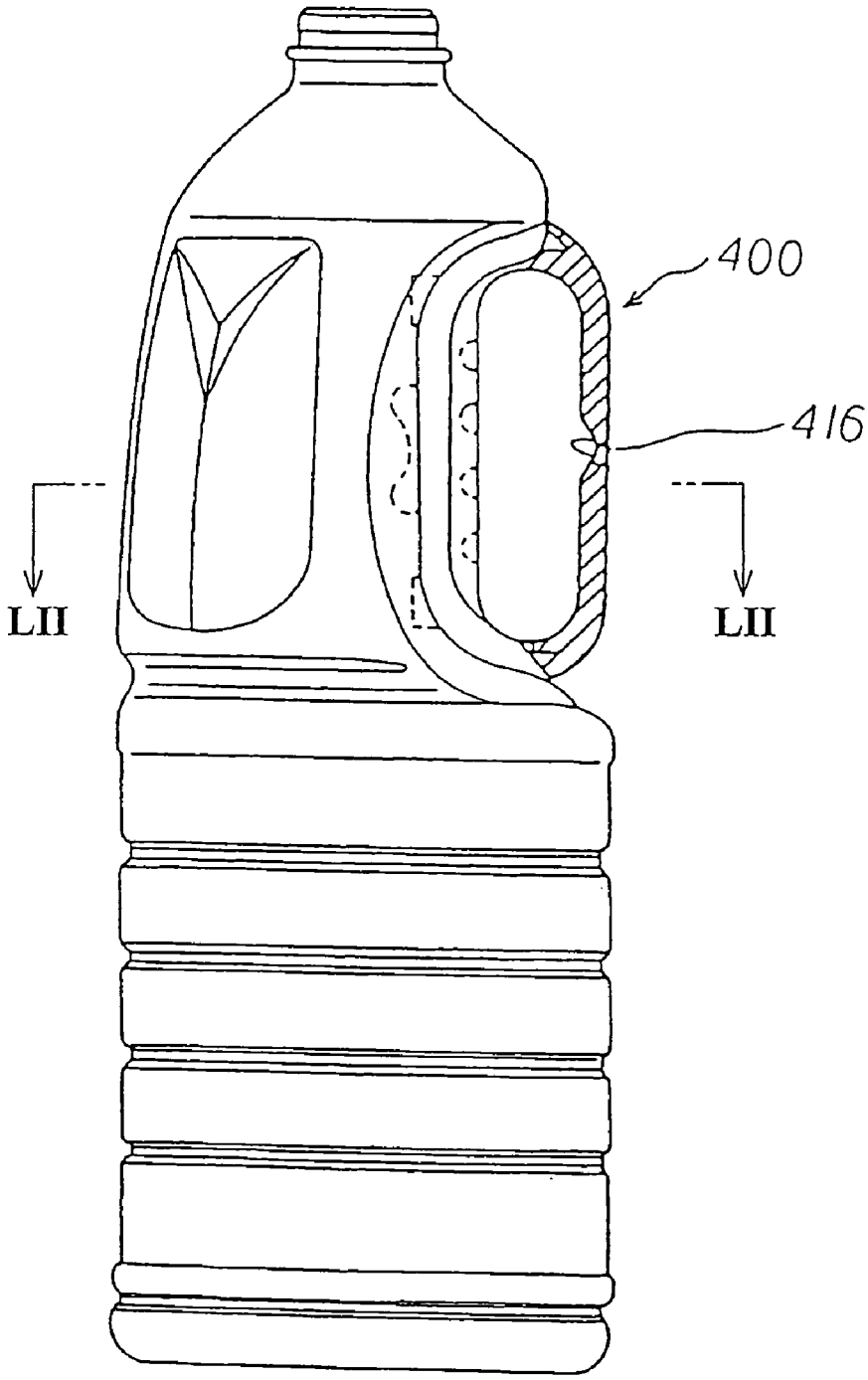
FIG. 50 is a partially cut-away front view of the example of the bottle provided with a handle which is separately manufactured.
Figure 51:
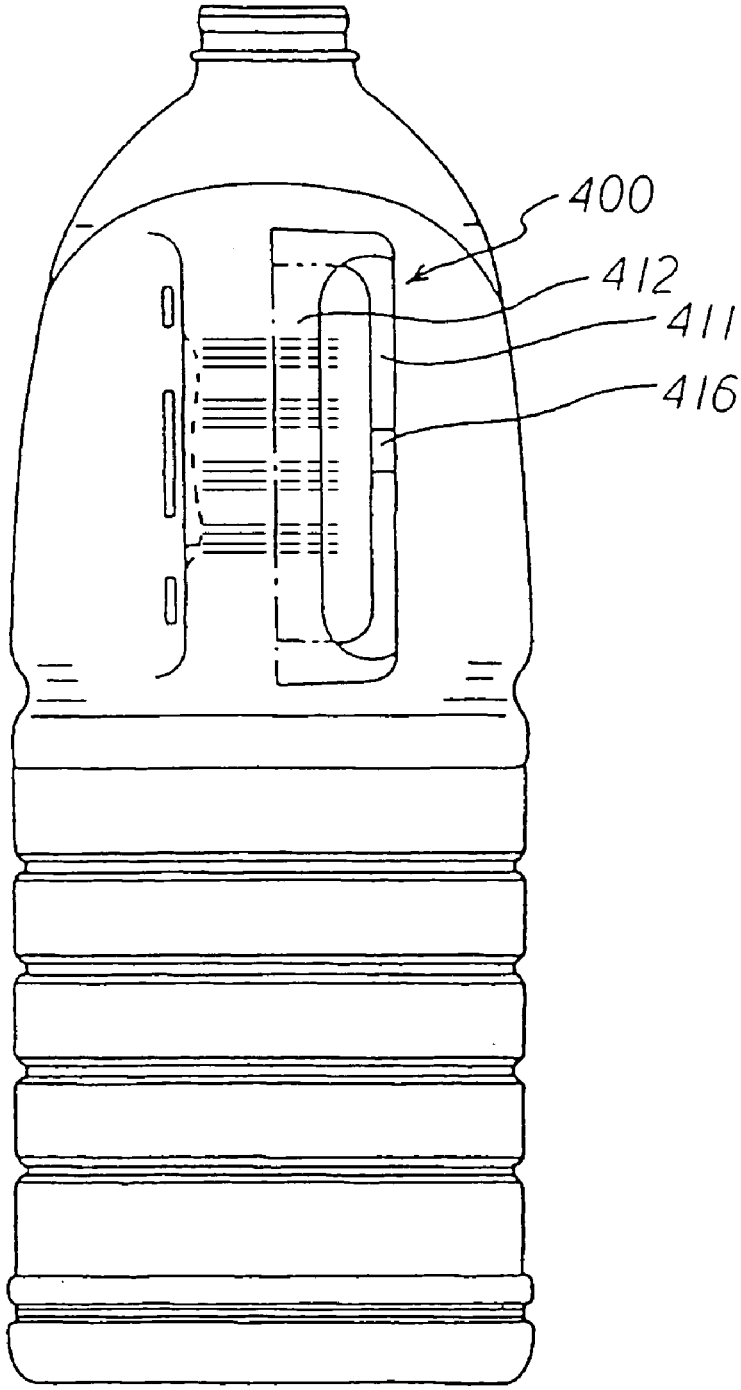
FIG. 51 is a right side view of the bottle shown in FIG. 50 in which the left half portion from the right side of the handle is eliminated.
Figure 52:
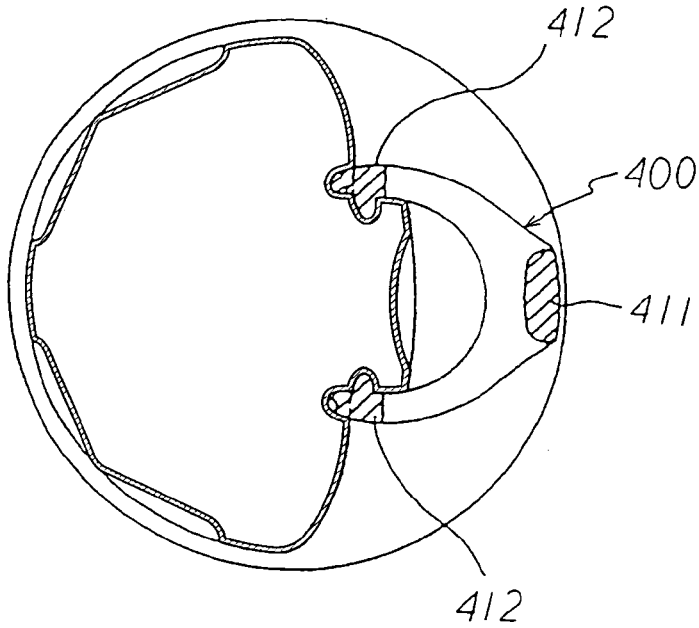
FIG. 52 is an enlarged cross sectional view along line A-A of the FIG. 50.
Figure 53:
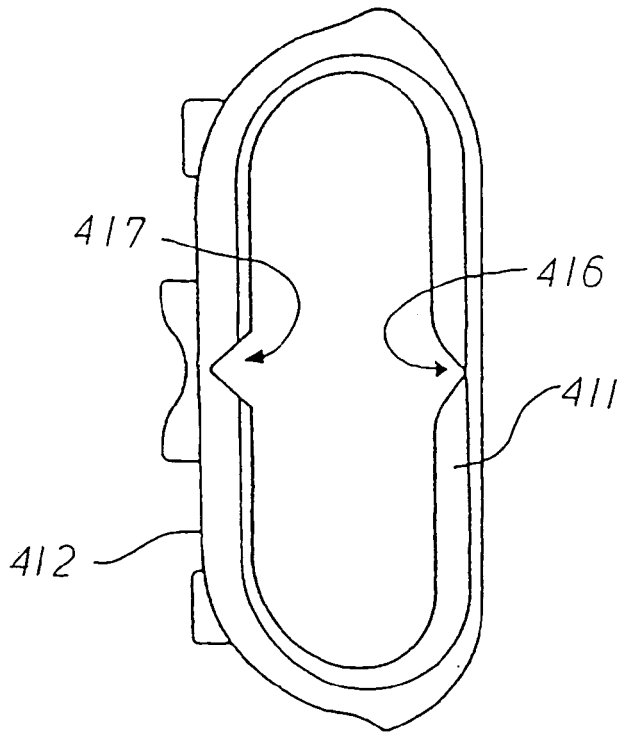
FIG. 53 is a front view of the handle limited for the example shown in FIG. 50.

In FIG. 49, a cap Ba comprises a cap base Ba1 and a cover Ba2.

A protruding ring 195 bulged from a cylinder wall is provided on the upper end circumference of a cover Ba2. An engaging ring 198 is provided in series on the outer circumference of the protruding ring 195 by a connecting piece 197 capable of cutting away easily from a hinge type connecting portion 196.

The hanging member of the bottom may be a hanging bar as shown in FIG. 46 (*b*), and may be a hanging pin or a hanging piece respectively as shown in FIG. 47 (*b*) (*c*).

For obtaining the folded bottle, when the engaging ring 198 of the cap cover Ba2 is to be pulled up from the axis of the connecting portion 196, the connecting piece 197 is cut, thereby as shown in FIG. 49 (*b*), the engaging ring 198 is subject to be rotatable in respect of the cover Ba 2 via the connecting portion 196.

In a manner described above, when the cover Ba1 is so engaged that the connecting portion 196 is lead to the bottom side of the bottle and when the engaging ring is engaged with the hanging member of the bottle bottom, the engagement of the neck and the bottom of the bottle is kept through the cap Ba.

For the engaging member of the cap, the engaging ring 198 may be altered with the engaging piece with a spherical head as shown by the seventh example, which is protruded from the cap base or the cover, and the engaging hole with spherical aperture as shown in FIG. 44 (*b*) may be provided.

Further, the cap may be provided with a hinge type openable cover. Other than the members described above, the engaging member and the hook member as shown in the seventh to the tenth examples may be applicable.

EFFECT OF THE INVENTION

The bottle with a handle according to the present invention is composed as described hereinbefore and has following effect.

The handle can be easily squeezed by providing the squeezable and deformable portion to efficiently decrease the volume of the upper portion of the handle body.

Therefore, the bottle with the handle can be a flat bottle which volume is considerably decreased.

The flattened body of the bottle is further deformed to be curved by applying the bending force throughout the bottle, so that the flattened bottle can be further folded. When the hook of the hanging piece provided on the bottom wall is engaged with the engaging piece on the neck of the bottle or on the handle, a less volume folded bottle can be obtained.

Furthermore, in case of engaging the hook with the piece, the bottle is necessarily wasted separately from the cap, thereby different kinds of materials are capable of preventing from mixed to waste things.

Since the indication showing the sequence numbers and the operation of squeezing is formed in the predetermined place, the bottle can be easily squeezed to obtain a waste bottle by squeezing the bottle in accordance with the indications.

INDUSTRIAL APPLICABILITY

As described hereinbefore, the plastic bottle with the handle of the present invention has a predetermined intensity, and is thus useful for containing food liquid, drinking liquid, water and the like.

Further, when the bottle is wasted after using, it is easily to squeeze it to the flattened bottle folded into a considerably decreased volume thereof so as to have an efficiency of transporting waste things for an useful recycling the waste plastic.

What is claimed is:

1. A squeezable plastic bottle having a longitudinal axis that defines a longitudinal direction of the bottle and a handle that extends in the longitudinal direction between upper and lower end portions of the handle, the handle including a middle portion between the upper and lower end portions, wherein the middle portion of the handle includes a bending deformation portion in the handle that allows the middle portion of the handle to bend radially inwardly towards the longitudinal axis of the bottle, wherein the bending deformation portion of the handle comprises an outwardly stepped wall that bulges outwardly beyond adjacent upper and lower end portions of the handle, and a bending portion.

2. The plastic bottle according to claim 1, further comprising a bending rib disposed in a connecting portion between the handle and the bottle.

3. A squeezable plastic bottle having a longitudinal axis that defines a longitudinal direction of the bottle and comprising a neck, a body including a handle, and a bottom, wherein said body comprises an upper body including the handle and a lower body, the body is squeeze-deformable by disposing a bending rib in the lower body, the handle extends in the longitudinal direction between upper and lower end portions of the handle, the handle including a middle portion between the upper and lower end portions, the handle including a bending deformation in the middle portion of the handle that allows the middle portion of the handle to bend radially inwardly towards the longitudinal axis of the body, the upper body comprises a side wall and an inwardly curved wall facing to the handle, and the upper body is bendable by forming bending ribs laterally extending on the inwardly curved wall and the side wall adjacent to said inwardly curved wall.

4. The rectangular plastic bottle according to claim 3, wherein said lower body has a rectangular cross section, said lower body has an equilateral octagonal body wall, and comprises a left side wall, a right side wall, a front-left side wall, a rear-left side wall, a front-right side wall, a rear-right side wall, a front wall and a rear wall, a lateral rib adjacent to the upper body is formed in the right side wall, the front-right side wall and the rear-right side wall at their upper ends, the right side wall, the front-right side wall and the rear-right side wall are further formed with a lateral rib at their lower ends, and each of the front-left side wall, the front-rear side wall, the front-right side wall and the rear-right side wall is formed with an inclined rib.

5. The plastic bottle according to claim 4, wherein an indication showing a sequence for squeezing operation procedures for collapsing a bottle is attached in a predetermined place on the bottle.

6. The plastic bottle according to claim 3, further comprising a bending rib disposed in a connecting portion between the handle and the bottle.

7. A squeezable plastic bottle having a longitudinal axis that defines a longitudinal direction of the bottle and comprising a neck, a body including a handle, and a bottom, wherein said body comprises an upper body including the handle and a lower body, the body is squeeze-deformable by disposing a bending rib in the lower body, the handle extends in the longitudinal direction between upper and lower end portions of the handle, the handle including a middle portion between the upper and lower end portions, the handle including a bending deformation in the middle portion of the handle that allows the middle portion of the handle to bend radially inwardly towards the longitudinal axis of the body, and wherein a hanging member is projected from the bottom and an engaging piece is provided on the upper body, said hanging member being matable upon collapse of the bottle with the engaging piece to retain the bottle in a collapsed state.

8. The plastic bottle according to claim 7, wherein the engaging piece includes a hook protruded upwardly from the upper end portion of the handle, and the hanging member includes a hook projected from the bottom.

9. The plastic bottle according to claim 7, wherein the engaging piece is provided on the neck or the shoulder of the body above the handle, and the hanging member includes a hook provided in the bottom.

10. The plastic bottle according to claim 7, wherein the engaging piece is attached to the neck.

11. The plastic bottle according to claim 7, wherein a cap provided with an engaging portion is attached to the neck of the bottle and forms said engaging piece.

12. The plastic bottle according to claim 11, wherein an indication showing a sequence for squeezing operation procedures for collapsing a bottle is attached in a predetermined place on the bottle.

13. A squeezable plastic bottle having a longitudinal axis that defines a longitudinal direction of the bottle and comprising a neck, a body including a handle, and a bottom, wherein said body comprises an upper body including the handle and a lower body, the body is squeeze-deformable by disposing a bending rib in the lower body, and the handle extends in the longitudinal direction between upper and lower end portions of the handle, the handle including a middle portion between the upper and lower end portions, the handle including a bending deformation in the middle portion of the handle that allows the middle portion of the handle to bend radially inwardly towards the longitudinal axis of the body, wherein an indication showing a sequence for squeezing operation procedures for collapsing a bottle is attached in a predetermined place on the bottle.

14. A squeezable plastic bottle having a longitudinal axis that defines a longitudinal direction of the bottle and comprising a neck, a body including a handle, and a bottom, wherein said body comprises an upper body including the handle and a lower body, the body is squeeze-deformable by disposing a bending rib in the lower body, and the handle extends in the longitudinal direction between upper and lower end portions of the handle, the handle including a middle portion between the upper and lower end portions, the handle including a bending deformation in the middle portion of the handle that allows the middle portion of the handle to bend radially inwardly towards the longitudinal axis of the body, wherein the lower body has a circular cross section, said lower body includes a circular cylindrical wall and a bottom circumferential wall, said lower body is formed with longitudinal ribs on front and rear surfaces of the cylindrical wall respectively, said lower body is formed with an arcuate rib connecting upper ends of said longitudinal ribs, and said lower body is formed with inclined ribs and a lateral rib, each of said inclined ribs downwardly extending right or left to the bottom circumferential wall, said lateral rib extending in a right side circumferential wall, an upper end of each of the inclined ribs being spaced apart from a lower end of said longitudinal rib, each of ends of said lateral rib being spaced apart from the lower end of said longitudinal rib.

15. The plastic bottle according to claim 14, further comprising a bending rib disposed in a connecting portion between the handle and the bottle.

16. The plastic bottle according to claim 3, wherein the lower body has a circular cross section, said upper body has a rectangular body circumferential wall, and comprises a shoulder, a left side wall, a front-left wall, a rear-left wall, a front side wall, a rear side wall and an inwardly curved wall, said lower body comprises a cylindrical wall having a circular cross section and a bottom circumferential wall, said cylindrical wall is formed with longitudinal ribs, one of said longitudinal ribs coincides with a ridge line between the front-left wall and the front wall of said upper body and with a ridge line between the rear-left wall and the rear wall, said circumferential wall is formed with lateral ribs connecting lower ends of said longitudinal ribs, and said cylindrical wall is formed with a lateral rib adjacent to the circumferential wall in a right side, said lateral rib connecting upper ends of said longitudinal ribs.

17. A squeezable plastic bottle having a longitudinal axis that defines a longitudinal direction of the bottle and a handle that extends in the longitudinal direction between upper and lower end portions of the handle, the handle including a middle portion between the upper and lower end portions, wherein the middle portion of the handle includes a bending deformation portion in the handle that allows the middle portion of the handle to bend radially inwardly towards the longitudinal axis of the body, wherein the handle is integrally formed in one-piece with the body.

18. The plastic bottle according to claim 17, further comprising a bending rib disposed in a connecting portion between the handle and the bottle.

* * * * *